US007543928B2

(12) United States Patent
Choo et al.

(10) Patent No.: US 7,543,928 B2
(45) Date of Patent: Jun. 9, 2009

(54) INKJET IMAGE FORMING APPARATUS AND METHOD OF PERFORMING HIGH RESOLUTION PRINTING USING A MULTI-PASS METHOD

(75) Inventors: Hyun-jin Choo, Suwon-si (KR); Dong-kee Jung, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 271 days.

(21) Appl. No.: 11/440,254

(22) Filed: May 25, 2006

(65) Prior Publication Data

US 2006/0268090 A1 Nov. 30, 2006

(30) Foreign Application Priority Data

May 30, 2005 (KR) ..... 10-2005-0045609

(51) Int. Cl.

| | |
|---|---|
| ***B41J 29/38*** | (2006.01) |
| ***B41J 23/00*** | (2006.01) |
| ***B41J 2/145*** | (2006.01) |
| ***B41J 2/15*** | (2006.01) |
| ***B41J 2/01*** | (2006.01) |

(52) U.S. Cl. ..... 347/104; 347/16; 347/37; 347/14; 347/41

(58) Field of Classification Search ..... 347/14, 347/16, 37, 41, 104
See application file for complete search history.

(56) References Cited

U.S. PATENT DOCUMENTS

| | | | | |
|---|---|---|---|---|
| 4,675,696 | A * | 6/1987 | Suzuki | 346/46 |
| 5,710,582 | A * | 1/1998 | Hawkins et al. | 347/42 |
| 5,729,790 | A * | 3/1998 | Conley et al. | 399/77 |
| 6,234,605 | B1 * | 5/2001 | Hilton | 347/42 |

FOREIGN PATENT DOCUMENTS

| | | |
|---|---|---|
| JP | 4-189170 | 7/1992 |
| JP | 6-71947 | * 3/1994 |
| JP | 2000-25207 | 1/2000 |
| JP | 2004-142100 | 5/2004 |
| KR | 1999-20089 | 3/1999 |
| KR | 1999-49402 | 7/1999 |

* cited by examiner

*Primary Examiner*—Julian D Huffman
(74) *Attorney, Agent, or Firm*—Stanzione & Kim, LLP

(57) ABSTRACT

An inkjet image forming apparatus and a method of performing a high resolution printing using multiple passes. In the inkjet image forming apparatus and a method of performing a high resolution printing, it is possible to obtain a resolution that is higher than an actual resolution of a print head by performing a printing operation several times on a printing medium in a multi-pass type printing method while moving the print head along a length direction thereof. As a result, printing quality can be improved by minimizing visibility of missing dots that occur due to failed nozzles.

16 Claims, 14 Drawing Sheets

INKJET IMAGE FORMING APPARATUS AND METHOD OF PERFORMING HIGH RESOLUTION PRINTING USING A MULTI-PASS METHOD

CROSS-REFERENCE TO RELATED APPLICATIONS

This application claims the benefit of Korean Patent Application No. 10-2005-0045609, filed on May 30, 2005, in the Korean Intellectual Property Office, the disclosure of which is incorporated herein in its entirety by reference.

BACKGROUND OF THE INVENTION

1. Field of the Invention

The present general inventive concept relates to an inkjet image forming apparatus, and more particularly, to an inkjet image forming apparatus that performs a high resolution using a multi-pass method.

2. Description of the Related Art

Inkjet image forming apparatuses are apparatuses for forming an image by ejecting ink to a printing medium. An inkjet image forming apparatus can be classified as a shuttle type and a line printing type. The shuttle-type inkjet image forming apparatus performs a printing job using a print head that reciprocates in a direction perpendicular to a transfer direction of a printing medium. The line printing-type inkjet image forming apparatus performs a printing job using a print head with a nozzle unit having a length that corresponds to a width of the printing medium.

Generally, a horizontal resolution of the inkjet image forming apparatus physically depends upon a gap between nozzles in the print head, that is, a nozzle pitch. A vertical resolution depends upon a transfer speed of the printing medium. Specifically, the print head of the line printing-type inkjet image forming apparatus is fixed and only the printing medium is transferred. Accordingly, when a desired resolution is greater than an actual resolution of the print head, it is difficult to provide a high-resolution printing. Since only the printing medium is transferred and the print head is fixed, the nozzles provided in the print head correspond to the transfer direction of the printing medium. FIG. 1 illustrates a print pattern formed when a nozzle unit 80 is damaged in a conventional inkjet image forming apparatus. As illustrated in FIG. 1, when a nozzle 84 is damaged, a missing line such as a white line appears on the printing medium. That is, when a part of the nozzle unit 80 of the conventional inkjet image forming apparatus is damaged, a missing line appears in the printing medium.

Referring to FIG. 1, in the conventional inkjet image forming apparatus, ink I ejected from nozzles 82 arrives at the printing medium, thereby forming an image. The conventional nozzle unit 80 is disposed perpendicular to the transfer direction of the printing medium and ejects ink droplets I to the printing medium to form an image. Therefore, when a part of the nozzles 84 are damaged, the damaged nozzles 84 (e.g., missing nozzles) do not eject ink, and missing lines such as white lines appear due to missing dots. That is, when some of the nozzles 84 are damaged, the ink droplets I are not ejected to the printing medium from the damaged nozzles 84, thereby causing the missing lines on the printing medium where the damaged nozzles 84 would have printed. This printing failure may not cause a problem in printing image data having a low printing density, however, the printing failure has a substantial negative impact on printing quality when printing image data having a high printing density.

A conventional method of compensating for deterioration in image quality caused by damage nozzles is described in U.S. Pat. No. 5,581,284. The conventional method corrects a printing failure due to failed nozzles (i.e., missing nozzles) in an inkjet image forming apparatus. Here, the failed nozzles represent nozzles which do not normally eject ink droplets such as damaged nozzles or weak nozzles. The conventional method can compensate for a black color, but cannot compensate for other colors. Since nozzles used to eject cyan ink, magenta ink, and yellow ink do not work when printing the black color, a process black can be formed using these different color inks. However, when an image having various colors is printed (i.e., when the nozzles for cyan ink, magenta ink, and yellow ink are used to eject ink), the compensation cannot be performed. In addition, when one nozzle is damaged, the missing lines are corrected using another color such as red (yellow+magenta), green (cyan+yellow), and blue (cyan+magenta), which are contrasted with the process black such that the printed image quality is negatively affected. Furthermore, since color ink or mixed ink should be ejected so as to compensate for the black color, an amount of the color ink to be used is increased, thereby shortening a lifespan of an ink cartridge.

According to the conventional nozzle unit 80 and the conventional method described above, it is not easy to perform a printing job with a resolution higher than the actual resolution of the print head. In addition, the printing failure due to the failed nozzles may cause a problem in increasing a printing speed and an image quality of the inkjet image forming apparatus.

SUMMARY OF THE INVENTION

The present general inventive concept provides an image forming apparatus and a printing method to perform a print job with a resolution that is higher than an actual resolution of a print head. In addition, the present general inventive concept provides an inkjet image forming apparatus and a printing method in which a reduction in image quality due to failed nozzles (which fail to eject ink or are weaker than normal functioning nozzles) can be efficiently compensated for.

Additional aspects of the present general inventive concept will be set forth in part in the description which follows and, in part, will be obvious from the description, or may be learned by practice of the general inventive concept.

The foregoing and/or other aspects of the present general inventive concept may be achieved by providing an inkjet image forming apparatus including a print head to eject ink to form an image on a printing medium that is transferred along a first direction and being movable in a second direction with respect to the printing medium, a first transfer path to guide the printing medium such that the printing medium is transferred to the print head, a second transfer path connected to the first transfer path to guide the printing medium such that the printing medium on which the image is printed is transferred back to the first transfer path, a path switching guide unit provided where the first transfer path and the second transfer path meet each other and to guide the printing medium such that the printing medium is discharged from the apparatus or transferred to the second transfer path, a printing medium transfer unit provided in the first and second transfer paths to transfer the printing medium along the first and second transfer paths, a head moving unit to move the print head in the second direction, and a control unit to synchronize operations of the path switching guide unit, the printing medium transfer unit, and the head moving unit such that the ink ejected from the print head reaches a target portion on the printing medium. The control unit moves the print head in the second direction when the printing medium is transferred to the first transfer path along the second transfer path.

The inkjet image forming apparatus may further include a print environment information unit to store information about a selected printing resolution when printing with the selected printing resolution is performed. The control unit may move the print head in accordance with the selected printing resolution stored in the print environment information unit.

The control unit may control the path switching guide unit such that the printing medium is repeatedly transferred along the second transfer path (N−1) times, where "L" represents the selected printing resolution, "M" represents an actual resolution of the print head, and "N" is equal to (L/M).

The control unit may control the head moving unit such that the print head is shifted in the second direction by (1/N)×D+(n×D) with respect to an initial position of the print head each time the printing medium is transferred along the second transfer path, where "D" is a nozzle pitch and "n" is an integer.

The control unit may control the head moving unit such that the print head is shifted in the second direction by (m/N)×D+(n×D) with respect to the initial position of the print head each time the printing medium is transferred along the second transfer path, where "D" is a nozzle pitch, "n" is an integer, and "m" is varied from 0 up to (N−1) by incrementing each time the printing medium P is transferred along the second transfer path.

The head moving unit may include a driver to move the print head to reciprocate in the second direction.

The driver may include a piezoelectric actuator coupled to the print head.

The head moving unit may further include a bias unit to bias the print head moved by the driver toward an initial position.

The bias unit may include an elastic member disposed between a main body frame of the inkjet image forming apparatus and the print head.

The head moving unit may further include a guide portion to guide the reciprocation of the print head.

The print head may include a coupling portion penetrated along a portion of the print head, and the guide portion may include a guide shaft inserted into the coupling portion to guide the reciprocation of the print head.

The guide portion may include a guide rail to guide the reciprocation of the print head.

The path switching guide unit may include a guide body, a first shaft disposed on the guide body to protrude from both side surfaces of the guide body, a second shaft inserted into an upper end portion of the guide body and having a shaft center that coincides with a shaft center of the first shaft, and a support portion formed at the upper end portion of the guide body to support the second shaft not to be separated therefrom.

The second shaft may be made of metal having a resistance to deformation.

The path switching guide unit may further include a plurality of grooves formed at a lower end portion of the guide body to be perpendicular to an edge of the lower end portion.

The support portion may include a plurality of first support portions protruding from a first side surface of the upper end portion of the guide body, and a plurality of second support portions protruding from a second side surface of the guide body to partially surround an outer circumferential surface of the second shaft along with the first support portions.

The print head may include a nozzle unit having a length that corresponds to a width of the printing medium.

The foregoing and/or other aspects of the present general inventive concept may also be achieved by providing an image forming apparatus, including a printing unit to print the first image on one of first and second surfaces of a printing medium, and a transfer path to guide the printing medium to the printing unit such that the printing unit prints a second image on the one of the first and second surfaces.

The foregoing and/or other aspects of the present general inventive concept may also be achieved by providing an image forming apparatus, including a printing unit to form a first image on a surface of a printing medium having a leading edge and a trailing edge, a first transfer path to guide the leading edge of the printing medium to the printing unit in a first direction, a second transfer path connected to the first transfer path to receive the leading edge from the first transfer path and to guide the leading edge of the printing medium having the surface with the first image such that the printing unit forms a second image on the surface having the first image; and a printing unit moving unit to move the printing unit in a second direction when the printing medium is returned to the printing unit by the second transfer path.

The foregoing and/or other aspects of the present general inventive concept may also be achieved by providing an inkjet image forming apparatus, including a loop transfer path having an inlet portion where a printing medium is input from a paper cassette, an outlet portion where the printing medium is discharged from the apparatus, a printing portion along which printing is performed on the printing medium, and a return portion along which the printing medium is returned to the printing portion, and a print head disposed in the printing portion of the loop transfer path to perform a print job on the printing medium and to move when the printing medium is returned to the printing portion via the return portion during the print job.

The foregoing and/or other aspects of the present general inventive concept may also be achieved by providing an inkjet image forming apparatus, including a frame, a cassette disposed in the frame and in which printing medium is stacked, a first transfer path disposed in the frame along a first direction and having an inlet to receive the printing medium from the cassette and an outlet through which the printing medium is discharged from the apparatus, a second transfer path disposed in the frame along the first direction and connected to the first transfer path, a print unit disposed in the first path and being movable in a second direction perpendicular to the first direction, and a sheet guide unit disposed where the first transfer path meets the second transfer path to guide the printing medium out of the apparatus via the outlet of the first transfer path or back to the first transfer path via the second transfer path.

The foregoing and/or other aspects of the present general inventive concept may also be achieved by providing an inkjet image forming apparatus, including a looped path having a printing path and a return path, a transfer unit disposed in the looped path to transfer a print medium in the looped path, a print head disposed in the printing path and being movable therein, and a control unit to control the transfer unit to transfer the print medium along the printing path N times and along the return path (N−1) times and to control the print head to print N respective overlapping portions of an image each time the print medium is passed along the printing path.

The foregoing and/or other aspects of the present general inventive concept may also be achieved by providing a method of performing a high resolution printing, the method including inputting a selected printing resolution from a host, comparing the input printing resolution with an actual resolution of a print head, printing a first image by ejecting ink to a printing medium while transferring the printing medium along a first transfer path, transferring the printing medium back to the first transfer path along a second transfer path when the input printing resolution is greater than the actual resolution of the print head, moving the print head along a length direction thereof, and printing a second image by ejecting ink from the moved print head onto the printing medium that is transferred again along the first transfer path.

The transferring of the printing medium may include repeatedly transferring the printing medium back to the first transfer path along the second transfer path (N−1) times, where "L" represents the input printing resolution, "M" represents the actual resolution of the print head, and "N" is equal to (L/M).

The moving of the print head may include shifting the print head along the length direction thereof by (1/N)×D+(n×D) with respect to an initial position of the print head each time the printing medium is transferred along the second transfer path, where "D" is a nozzle pitch and "n" is an integer.

The moving of the print head may include shifting the print head along the length direction thereof by (m/N)×D+(n×D) with respect to an initial position of the print head each time the printing medium is transferred along the second transfer path, where "D" is a nozzle pitch, "n" is an integer, and "m" is varied from 0 up to (N−1) by incrementing each time the printing medium P is transferred through the second transfer path.

The print head may include a nozzle unit having a length that corresponds to a width of the printing medium.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
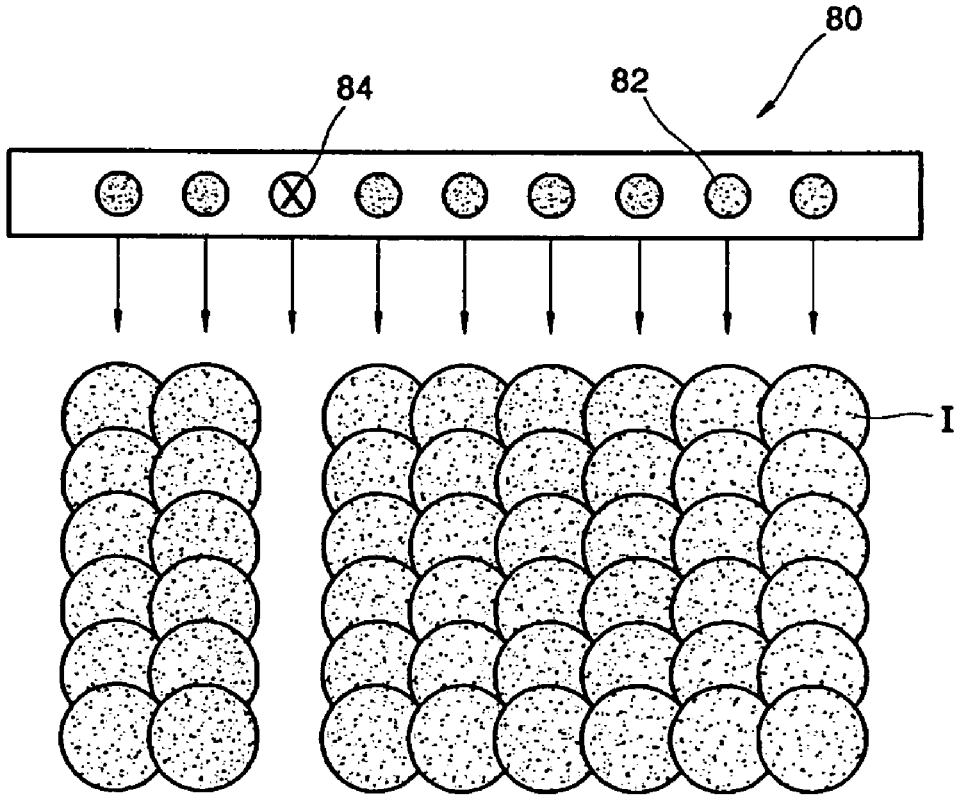
(PRIOR ART) FIG. 1
FIG. 1 illustrates a print pattern formed when a nozzle unit is damaged in a conventional inkjet image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures. Hereinafter, an inkjet image forming apparatus and a method of performing a high resolution printing of the inkjet image forming apparatus according to the present invention will be described with reference to the attached drawings. For explanation purposes, the entire structure of an inkjet image forming apparatus will be described first, and then the method of performing a high resolution printing will be described. The thicknesses of the lines or the sizes of the elements shown in the drawings are exaggerated for clarity.

Figure 2:
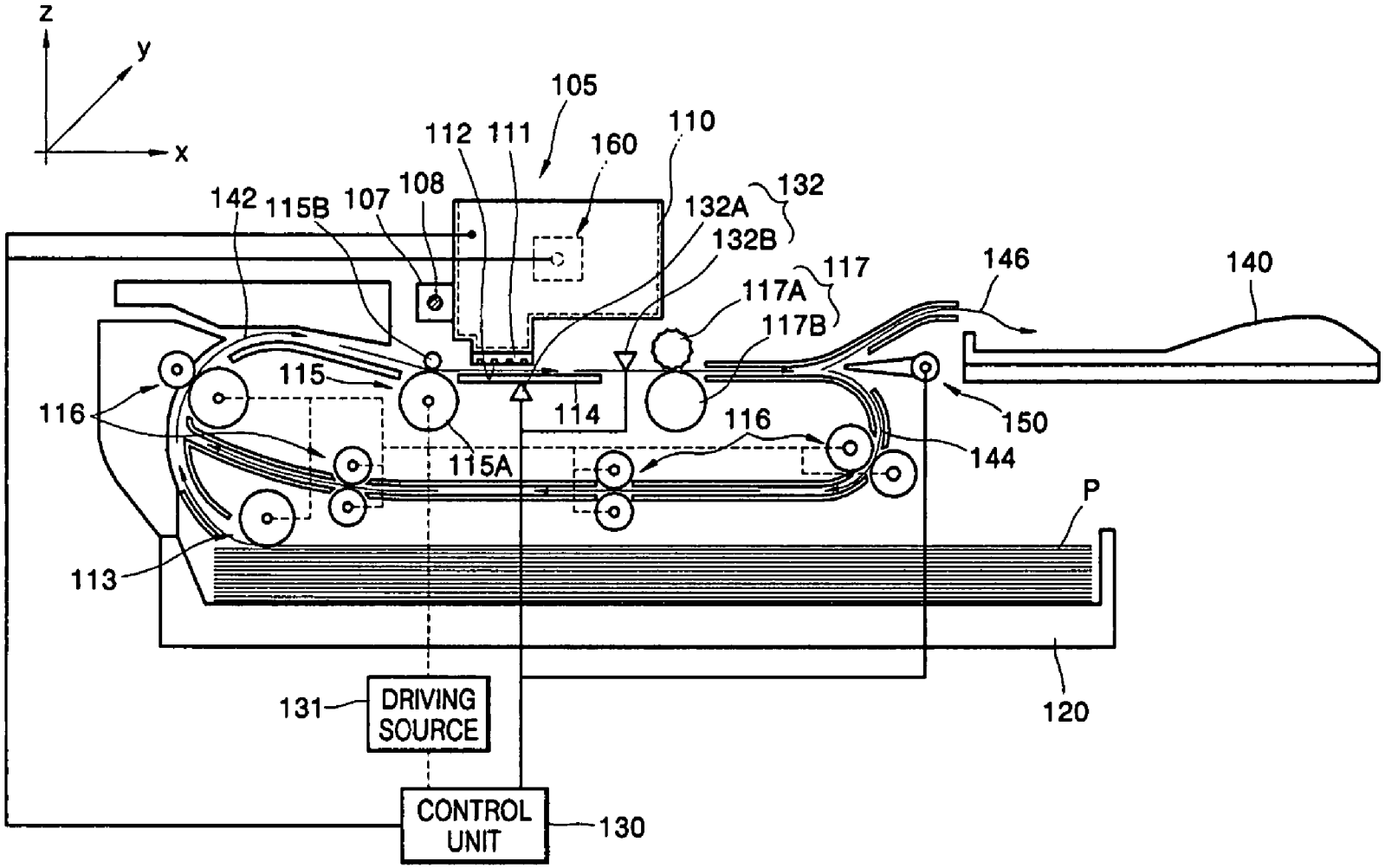
FIG. 2 schematically illustrates an inkjet image forming apparatus according to an embodiment of the present general inventive concept.
Figure 3:
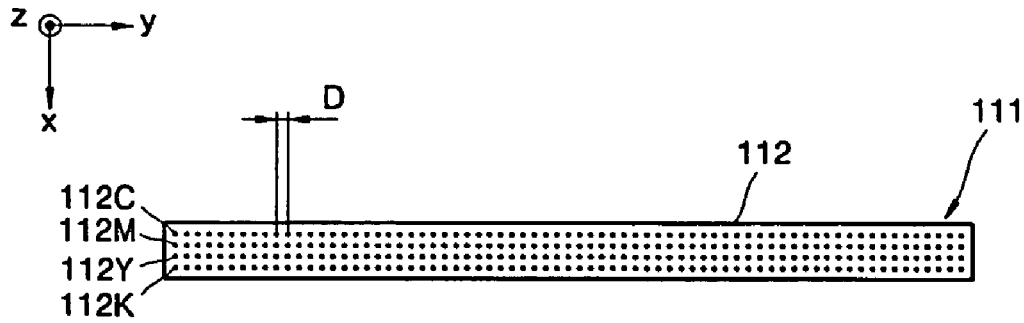
FIG. 3 illustrates an example of a nozzle unit of a print head of the image forming apparatus illustrated in FIG. 2.
Figure 4:
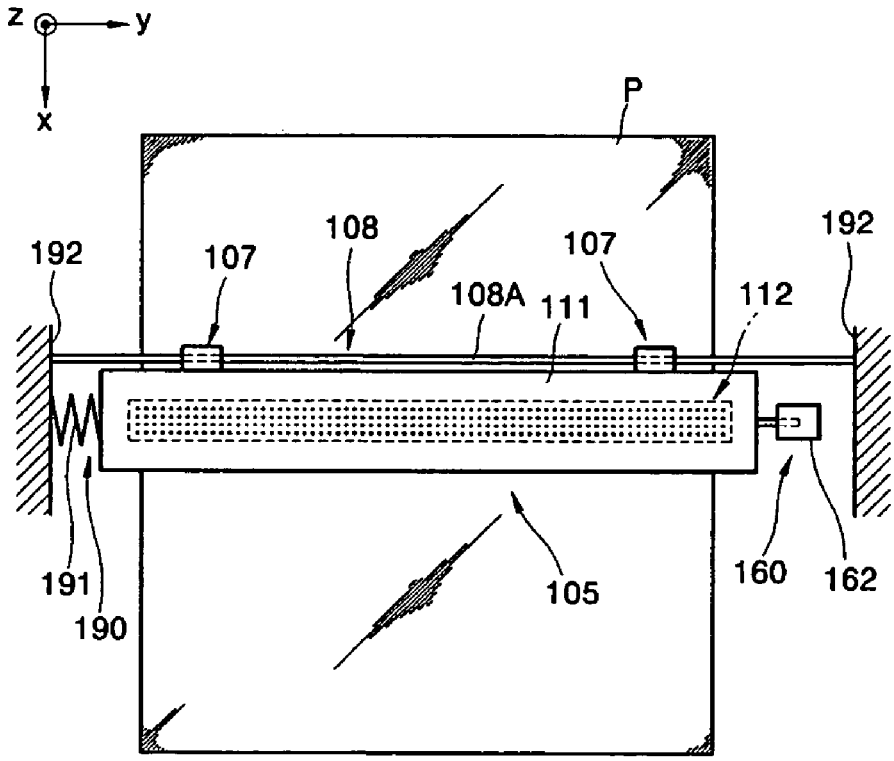
FIG. 4 illustrates an example of a head moving unit of the image forming apparatus of FIG. 2, according to an embodiment of the present general inventive concept.
Figure 5:
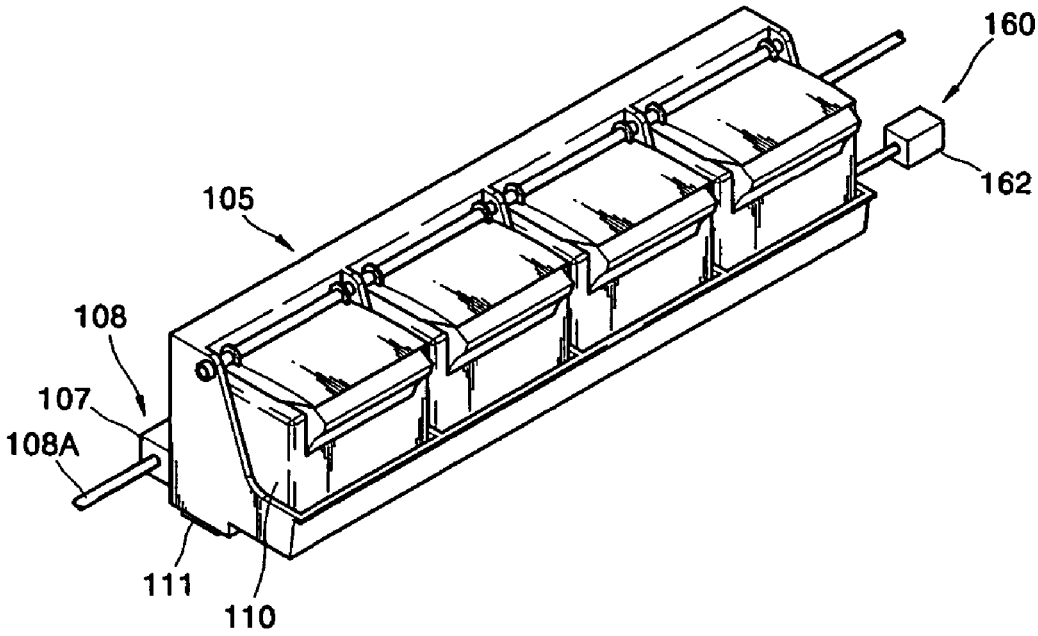
FIG. 5 is a perspective view illustrating the head moving unit of FIG. 4.
Figure 6:
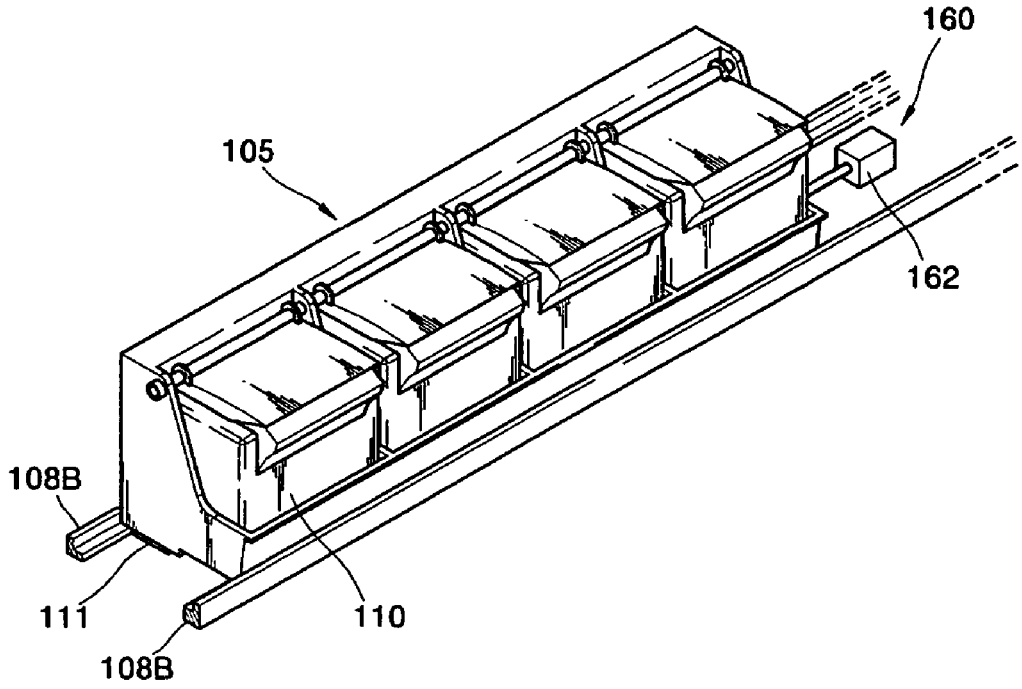
FIG. 6 is a perspective view illustrating another example of the head moving unit of the image forming apparatus of FIG. 2, according to an embodiment of the present general inventive concept.

FIG. 2 schematically illustrates an example of an inkjet image forming apparatus according to an embodiment of the present general inventive concept, and FIG. 3 illustrates an example of a nozzle unit 112 of a print head 111 of the image forming apparatus of FIG. 2. FIG. 4 illustrates an example of a head moving unit 160 of the image forming apparatus of FIG. 2, according to an embodiment of the present general inventive concept. FIG. 5 is a perspective view illustrating the head moving unit 160 of FIG. 4, and FIG. 6 is a perspective view illustrating another example of the head moving unit 160 of the image forming apparatus of FIG. 2, according to an embodiment of the present general inventive concept.

Referring to FIG. 2, the inkjet image forming apparatus includes a sheet feed cassette 120, a print head unit 105, a support member 114 opposite thereto, a sensing unit 132 to sense a failed nozzle, a printing medium transfer unit 113, 115, 116, and 117 to transfer a printing medium P, a path switching guide unit 150 to switch a transfer path of a printing medium P, the head moving unit 160 to move the print head unit 105, and a stacking unit 140 on which the discharged printing medium P is stacked. The inkjet image forming apparatus is provided with a control unit 130 to control operations of the respective elements. The print head unit 105 includes a body 110 movable by the head moving unit 160, the print head 111 disposed on a lower portion of the body 110, and the nozzle unit 112 disposed in the print head 111.

Printing media P are stacked on the sheet feed cassette 120. The printing media P stacked on the sheet feed cassette 120 are transferred to a first transfer path 142, a second transfer path 144, or a sheet discharge path 146 by the printing media transfer units 113, 115, 116, and 117. Here, the first transfer path 142 is a path along which the printing media P is guided to the print head 111, the second transfer path 144 is a path along which the printing media P that is transferred along the first transfer path 142 can be guided back to the first transfer path 142, and the sheet discharge path 146 is a path along which the printing media P that is transferred along the first transfer path 142 is guided to the stacking unit 140. The second transfer path 144 and the sheet discharge path 146 are connected to the first transfer path 142. A position at which the paths meet are provided with the path switching guide unit 150 to switch the transfer path of the printing media P, respectively. The structure and operation of the path switching guide unit 150 will be described in detail below. In the present embodiment, the x direction as a first direction represents a direction in which the printing medium P, which is picked up from the sheet feed cassette 120, is transferred to the print head 111. The y direction as a second direction represents a width direction of the printing medium P. The first direction and the second direction may be perpendicular to each other. The first direction and the second direction may form a predetermined angle.

The printing medium transfer unit 113, 115, 116, and 117 transfer the printing media P stacked on the sheet feed cassette 120 along a predetermined path. In the present embodiment, the printing medium transfer unit includes a pickup roller 113, a feeding roller 115, auxiliary rollers 116, and a sheet discharge roller 117. The printing medium transfer units 113, 115, 116, and 117 are driven by a driving source 131, such as a motor to apply a transfer force to transfer the printing medium P. The operation of the driving source 131 is controlled by the control unit 130 (described below).

The pickup roller 113 is provided at one end of the sheet feed cassette 120 and picks up the printing media P stacked on the sheet feed cassette 120, sheet by sheet. The pickup roller 113 transfers the printing media P out of the sheet feed cassette 120 by rotating while pressing a top surface of the printing media P. The feeding roller 115 is provided at an entrance side of the print head 111 and transfers the printing media P picked up by the pickup roller 113 to the print head 111. The feeding roller 115 includes a driving roller 115A to provide a transfer force to transfer the printing media P and an idle roller 115B to elastically engage the driving roller 115A. The feeding roller 115 may perform a function of arranging the printing media P such that ink can be ejected to a desired portion of the printing media P, before the printing media P is passed under the print head 111.

The auxiliary rollers 116 transfer the printing media P along the first and second transfer paths 142 and 144 and are provided in the first transfer path 142 and the second transfer path 144. The auxiliary rollers 116 are supplied with power from the driving source 131 and transfer the printing media P.

The sheet discharge roller 117 is disposed at an exit side of the print head 111 and discharges the printing medium P out of the image forming apparatus, or transfers the printing medium P to the second transfer path 144. The printing medium P discharged from the image forming apparatus along the sheet discharge path 146 is stacked on the stacking unit 140. The sheet discharge roller 117 includes a star wheel 117A disposed along the width direction of the printing medium P and a support roller 117B disposed opposite to the star wheel 117A so as to support a back surface of the printing medium P. The printing medium P onto which the ink is ejected while passing under the nozzle unit 112 can be wet with the ink causing wrinkles to be generated therein. When the wrinkles are large, the printing medium P may come in contact with the nozzle unit 112 or a bottom surface of the body 110. As a result, the non-dried ink may spread and/or be smeared, thereby contaminating an image. A gap between the printing medium P and the nozzle unit 112 may not be maintained due to the wrinkles. The star wheel 117A prevents the printing medium P from coming in contact with the nozzle unit 112 or the bottom surface of the body 110 and prevents the gap between the printing medium P and the nozzle unit 112 from varying. At least a part of the star wheel 117A protrudes more than the nozzle unit 112 and comes in contact with the printing medium P. Accordingly, the star wheel 117A contacts the printing medium P and prevents the ink image on the printing medium P that has not yet dried, from being contaminated. A plurality of star wheels may be provided to smoothly transfer the printing medium P. When a plurality of star wheels are provided parallel to the transfer direction of the printing medium P, a plurality of support rollers corresponding to the plurality of star wheels may be further provided.

Additionally, when a print job is performed continuously, the back surfaces of the printing media P may be contaminated by discharging a next printing medium P, before the ink on a top surface of a current printing medium P is dried (i.e., after the current printing medium P is discharged on the stacking unit 140). In order to prevent the contamination of the back surface, an additional dry unit (not shown) may be further provided.

A support member 114 is provided below the print head 111 to maintain the gap between the nozzle unit 112 and the printing medium P constant and to support the back surface of the printing medium P. The gap between the nozzle unit 112 and the printing medium P may be about 0.5 mm to 2.5 mm.

The sensing unit 132 senses failed nozzles (i.e., defective or malfunctioning nozzles) of the nozzle unit 112 provided in the print head 111. Here, a failed nozzle is a nozzle which does not properly eject ink, such as a damaged nozzle, a missing nozzle, or a weak nozzle. That is, the failed nozzle fails to eject ink therefrom for various reasons, or the failed nozzle ejects an amount of ink that is less than a specified amount that the nozzle is designed to eject. The sensing unit 132 can sense the failed nozzle of the nozzle unit 112 before starting the print job, or while the print job is being performed. Accordingly, the sensing unit 132 includes a first sensing unit 132A to sense the failed nozzle of the nozzle unit 112 before starting the print job, and a second sensing unit 132B to sense the failed nozzle of the nozzle unit 112 while the print job is being performed. The first sensing unit 132A senses whether nozzle holes are blocked up by directly irradiating light to the nozzle unit 112, and the second sensing unit 132B senses whether a failed nozzle is generated by irradiating light to the transferred printing medium P. The first sensing unit 132A and the second sensing unit 132B may have a similar structure and operation, and thus only the structure and operation of the second sensing unit 132B to keep the description brief.

Generally, a print head of an inkjet image forming apparatus can be classified as one of two types depending upon a type of actuator that supplies power to eject ink droplets. One type is a thermal drive type in which bubbles are formed in the ink by a heater and the ink droplets are ejected by an expanding power of the bubbles. The other type is a piezoelectric drive type in which the ink droplets are ejected by a pressure applied to the ink due to deformation of a piezoelectric element. When the ink droplets are ejected in the thermal drive type, failure of nozzles due to a short-circuit or malfunction of the heater, or the damage of electrical elements such as FET (Field Emission Transistor) can be easily sensed. Similarly, when the ink droplets are ejected from the piezoelectric drive type, the failure of nozzles due to the failure of the piezoelectric elements or the damage of a driving circuit of the piezoelectric element can be easily sensed. The failure of a nozzle resulting from one of the above-mentioned causes can be sensed by the first sensing unit 132A, before beginning a print job.

However, a case in which a nozzle is blocked by particles cannot be easily sensed and confirmed. When the cause of the failed nozzle cannot be easily sensed, a test page printing can be performed. When a failed nozzle is generated, a print concentration of a portion of an image printed with the failed nozzle is lower than a print concentration of a portion of the image printed with a normal nozzle. Since the portion of the image having the lower print concentration is sensed by the second sensing unit 132B, a position of the failed nozzle can be sensed by the second sensing unit 132B. That is, the failed nozzle can be sensed using the above-mentioned method when the test page printing is performed or when the actual image printing is performed.

The second sensing unit 132B may be, for example, a photo sensor (not shown) including a light-emitting sensor. The light-emitting sensor may include a light-emitting diode to irradiate light to the printing medium P and a light-receiving sensor to receive light reflected from the printing medium P. The second sensing unit 132B can sense the failed nozzle based on an output signal of the light receiving sensor. Information about the failed nozzle is provided to the control unit 130. The first sensing unit 132A may operate in a similar manner as described above with respect to the second sensing unit 132B. Here, the light-emitting sensor and the light-receiving sensor may be integrally formed as a single body, or may be separately formed. Since the structure and operation of the photo sensor are known to those skilled in the art, a detailed description thereof will not be provided.

The print head unit 105 prints an image by ejecting ink onto the printing medium P and includes the body 110, the print head 111 disposed at one end of the body 110, and the nozzle unit 112 disposed in the print head 111. The feeding roller 115 is rotatably disposed at the entrance side of the nozzle unit 112 and the sheet discharge roller 117 is rotatably disposed at the exit side of the nozzle unit 112. Cables that deliver power or printing data as driving signals from the control unit 130 are connected to the nozzles of the nozzle unit 112, respectively. The cables may be flexible printed circuits (FPC) or flexible flat cables (FFC).

Referring to FIG. 3, the print head 111 includes the nozzle unit 112 to print an image on the printing medium P by ejecting ink. The print head 111 is movable in the second direction (y direction) relative to the first direction (x direction), which is the transfer direction of the printing medium P. The print head 111 uses thermal energy or the piezoelectric element to eject the ink, and the print head 111 is manufactured with a high resolution (i.e., a high actual resolution) using semiconductor manufacturing processes including, for example, etching, deposition, sputtering, and the like. Reference numeral "D" represents a nozzle pitch which is a factor in determining the actual resolution of the print head 111. The nozzle unit 112 is provided with a plurality of nozzle arrays 112C, 112M, 112Y, 112K to eject ink to the printing medium P to form the image. The nozzle unit 112 may have a length that is greater than or equal to the width of the printing medium P.

Although not illustrated, the body 110 is provided with an ink storage space of a cartridge type. The ink storage space is detachably provided in the body 110. In addition, the body 110 may further include chambers which communicate with the nozzles of the nozzle unit 112 and ejecting mechanisms disposed in the chambers (for example, piezoelectric elements and thermal driving heaters) to supply a pressure to eject the ink. The body 110 may further include flow paths (for example, orifices) to supply the ink stored in the body 110 to the chambers, a manifold which is a common flow path to supply the ink from the flow path to the chamber, and restrictors which are individual flow paths to supply the ink to the chambers from the manifold. Since the chambers, the ejecting mechanisms, the flow paths, the manifold, the restrictors, and the like are known to those skilled in the art, a detailed description thereof will not be provided.

Referring to FIGS. 2 and 4, the head moving unit 160 moves the print head 111 in the second direction (y direction). The head moving unit 160 is controlled by the control unit 130. The head moving unit 160 includes a driving unit 162 to reciprocate the print head 111 in the second direction. The driving unit 162 receives power from the main body of the inkjet image forming apparatus and is coupled to the print head 111 or a carriage (not shown) to reciprocate the print head 111. The driving unit 162 may be a piezoelectric actuator to drive a precision element, such as an optical mirror. The piezoelectric actuator is an element that is driven with a voltage and has a positional precision of several microns (um) and a high frequency response characteristic. Therefore, when the piezoelectric actuator is used as the driving unit 162, the operation of the print head 111 can be precisely controlled such that the ink droplets can reach desired positions of the transferred printing medium P. In the present embodiment, the case in which the print head 111 is reciprocated by the piezoelectric actuator has been used as an example, however, it should be understood that other types of movement mechanisms can be used as the driving unit 162.

The head moving unit 160 may further include a guide unit 108 to guide the reciprocation of the print head 111. As illustrated in FIGS. 4 and 5, the guide unit 108 may include a coupling section 107 and a guide shaft 108A. The coupling section 107 is formed at an end of the print head 111 and has a hollow portion. The guide shaft 108A is formed on a portion 192 of main body frame of the image forming apparatus and is inserted into the hollow coupling section 107 to guide the reciprocation of the print head 111. That is, the print head 111 is slidably coupled to the guide shaft 108A via the coupling section 107. Alternatively, as illustrated in FIG. 6, the guide unit 108 may include guide rails 108B. The guide rails 108B are provided at one side or both sides of the print head 111 to guide the reciprocation of the print head 111.

As illustrated in FIG. 4, the head moving unit 160 may further include a bias unit 190 which biases the print head 111 moved by the driving unit 162 toward an original position (i.e., an initial position of the print head 111). The bias unit 190 is provided between the main body frame 192 and the print head 111 of the inkjet image forming apparatus to elastically bias the print head 111 toward the driving unit 162. The bias unit 190 may be made of an elastic member 191, such as a spring.

Figure 7:
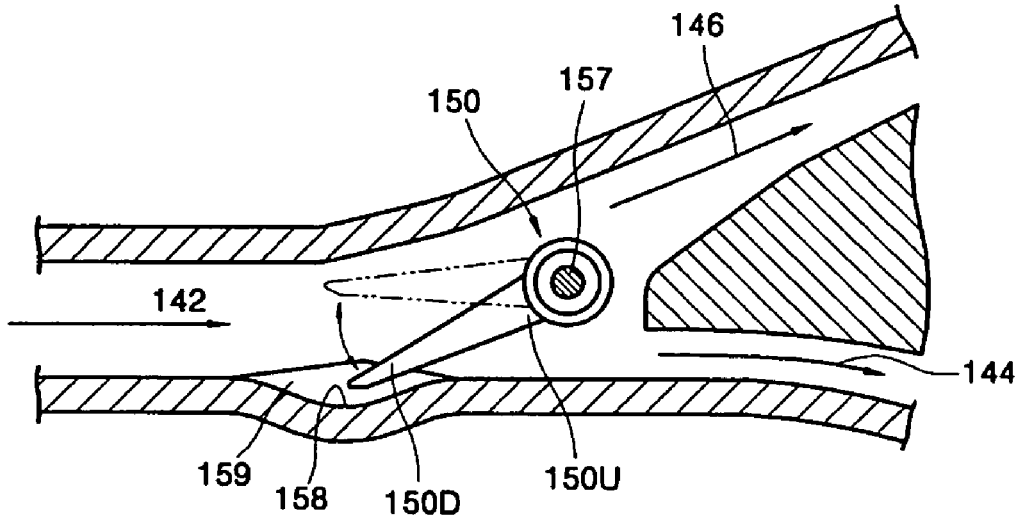
FIG. 7 is a cross-sectional view illustrating a path switching guide unit of the image forming apparatus of FIG. 2, according to an embodiment of the present general inventive concept.
Figure 8:
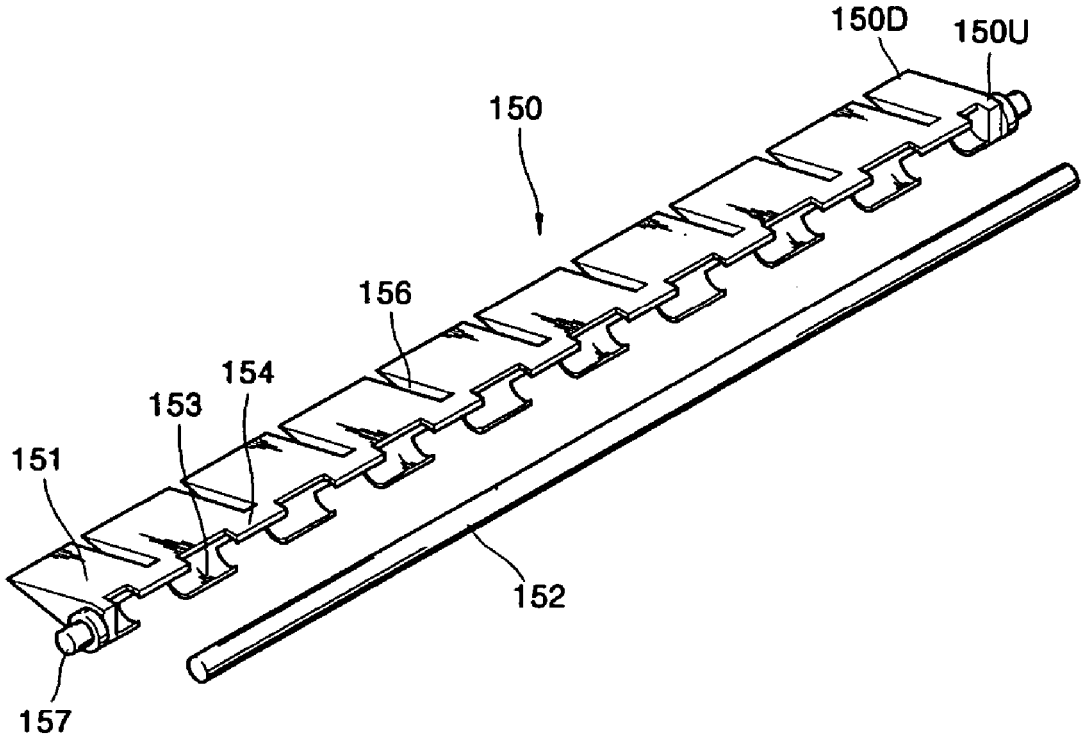
FIG. 8 is a separated perspective view illustrating the path switching guide unit of FIG. 7.
Figure 9:
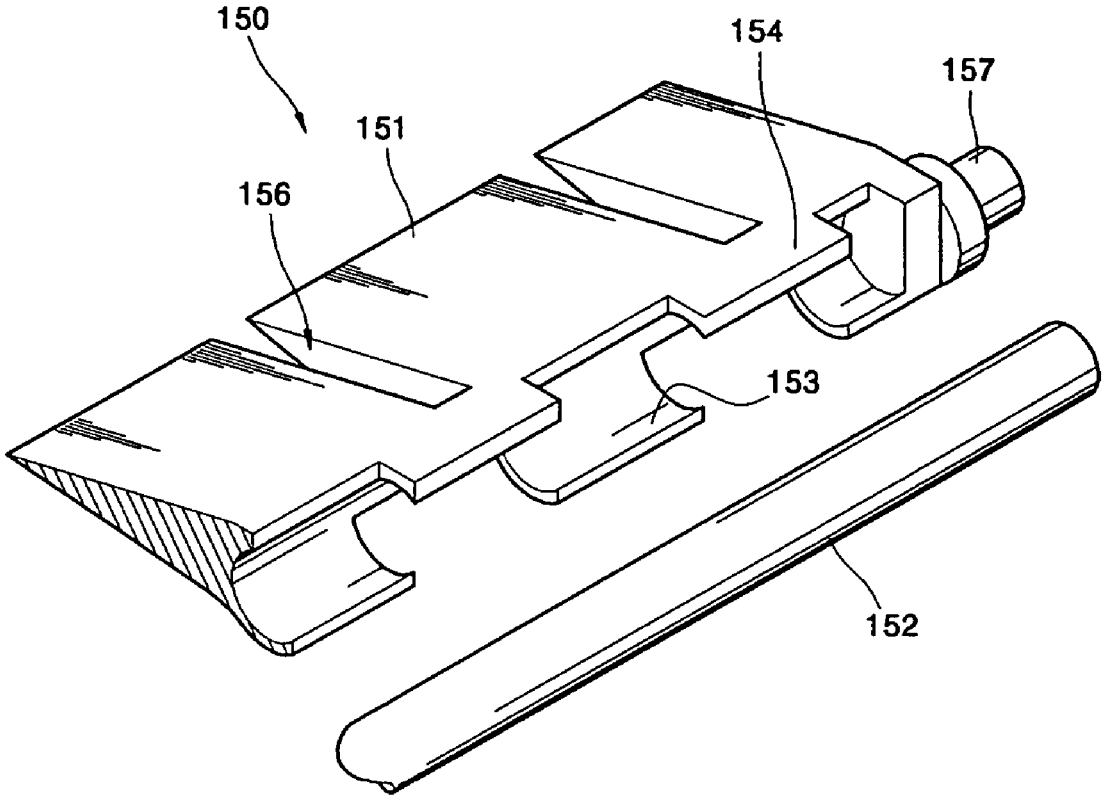
FIG. 9 is a partially-enlarged view of the path switching guide unit of FIG. 7, according to an embodiment of the present general inventive concept.
Figure 10:
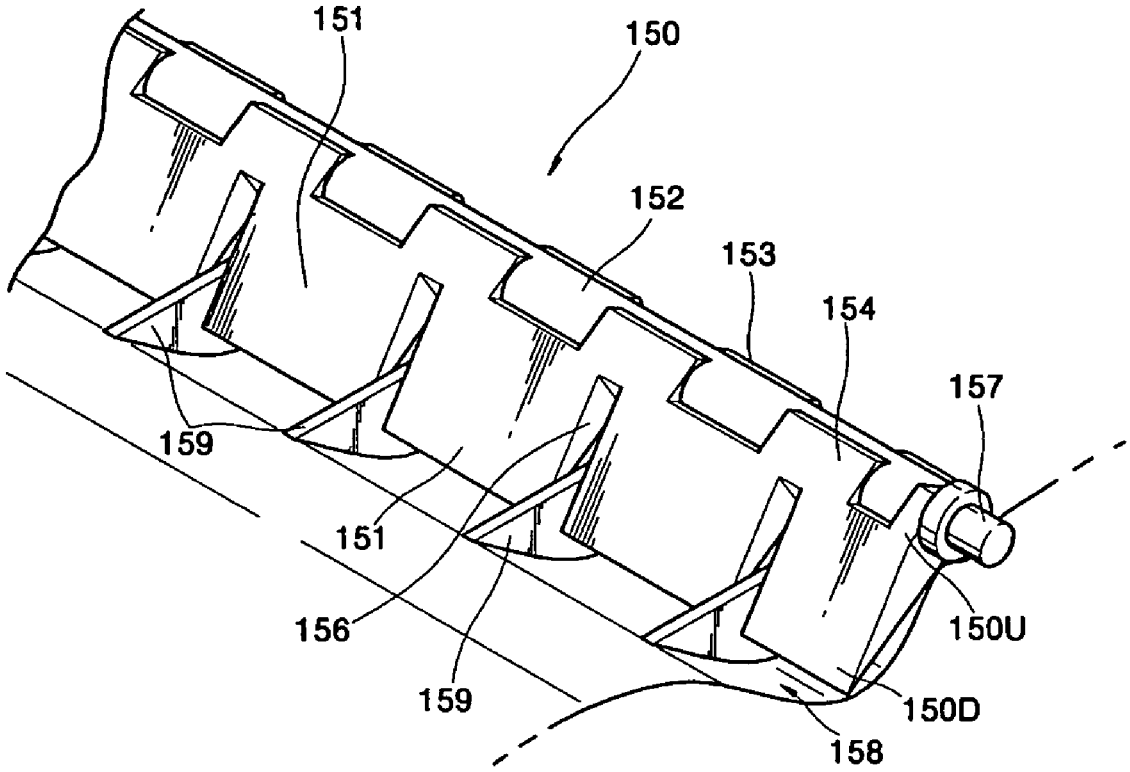
FIG. 10 schematically illustrates a state in which the path switching guide unit of FIG. 7 is installed in the image forming apparatus of FIG. 2, according to an embodiment of the present general inventive concept.

FIG. 7 is a cross-sectional view illustrating the path switching guide unit 150 of the image forming apparatus of FIG. 2, according to an embodiment of the present general inventive concept. FIG. 8 is a separated perspective view illustrating the path switching guide unit 150 of FIG. 7. FIG. 9 is a partially-enlarged view of the path switching guide unit 150 of FIG. 7, according to an embodiment of the present general inventive concept. FIG. 10 schematically illustrates a state in which the path switching guide unit 150 of FIG. 7 is installed in the image forming apparatus.

Referring to FIGS. 2 and 7, the path switching guide unit 150 is disposed at a position where the first transfer path 142 and the second transfer path 144 meet each other, and the path switching guide unit 150 guides the printing medium P such that the print medium P transferred along the first transfer path 142 is then transferred along the second transfer path 144 or is discharged through (i.e., along) the sheet discharge path 146. The path switching guide unit 150 may be made of a resin material having a longitudinal rectangular shape. When the path switching guide unit 150 is located at a first position indicated by a solid line in FIG. 7, the printing medium P transferred along the first transfer path 142 is then discharged via the sheet discharge path 146. When the path switching guide unit 150 is located at a second position indicated by a dotted line in FIG. 7, the printing medium P transferred along the first transfer path 142 is then transferred back to the first transfer path 142 via the second transfer path 144. The path switching guide unit 150 is controlled by the control unit 130. The path switching guide unit 150 may include a lower end portion 150D, which is pointed and switches the transfer path of the printing medium P. The path switching guide unit 150 also includes an upper end portion 150U rotatably supported by the main body frame of the image forming apparatus (not shown) about a first shaft 157.

Referring to FIG. 8, the path switching guide unit 150 includes a guide body 151, the first shaft 157 formed integrally with the guide body 151, a second shaft 152 inserted into the guide body 151, and support portions 153 and 154 to support the second shaft 152. The first shaft 157 protrudes from both side walls of the upper end portion 150U of the guide body 151. Here, the first shaft 157 can be formed as part of the guide body 151. The first shaft 157 is coupled to the main body frame (not shown) in the image forming apparatus and is rotated in a predetermined direction by the control unit 130.

An empty space may be formed in the upper end portion 150U of the guide body 151 such that the second shaft 152 can be inserted therein along a length direction thereof. Here, the empty space can be formed such that a center of the first shaft 157 and a center of the second shaft 152 are aligned when the second shaft 152 is inserted into the empty space. In this case, since the second shaft 152 is located at a rotation center of the path switching guide unit 150, a rotation moment is not affected at the time of rotation of the path switching guide unit 150.

The support portions 153 and 154 protrude from the upper end portion 150U of the guide body 151 such that the second shaft 152 can be fixed to the guide body 151 without departing therefrom. The support portions 153 and 154 may be made of the same materials and as part of the guide body 151. As illustrated in FIG. 9, the support portions 153 and 154 include a first support portion 153 and a second support portion 154 formed at both sides of the upper end portion 150U of the guide body 151. A vertical distance between the first support portion 153 and the second support portion 154 is smaller than an outer diameter of the second shaft 152. Therefore, when the second shaft 152 is inserted into the upper end portion 150U of the guide body 151, the second shaft 152 passes between the first and second support portions 153 and 154, which are elastically displaced apart. When the second shaft 152 is completely inserted into the empty space, the first and second support portions 153 and 154 are elastically restored to an original shape to surround an outer circumferential surface of the second shaft 152.

As illustrated in FIG. 9, the first support portion 153 and the second support portion 154 are formed opposite to each other and are divided from each other by a predetermined pitch. The first and second support portions 153 and 154 are alternately repeated along the length direction of the upper end portion 150U. Therefore, the second shaft 152 can be easily inserted and a cost of material can be reduced. As illustrated in FIGS. 7 to 9, the path switching guide unit 150 has a thickness that decreases from the upper end portion 150U toward the lower end portion 150D. Referring to FIGS. 7 to 10, a plurality of narrow grooves 156 are formed in the lower end portion 150D in a transferring direction in which the printing medium P is transferred. Guide ribs 159 provided in a concave portion 158 of the main body frame (not shown) are inserted into the grooves 156 when the path switching guide unit 150 is installed the image forming apparatus.

The second shaft 152 may be made of metal having a resistance to deformation. The path switching guide unit 150 may be deformed or warped at the time of switching the transfer path of the printing medium P. Since the second shaft 152 is made of metal having a resistance to deformation, it is possible to stably switch the transfer path of the printing medium P.

Referring to FIG. 10, the concave portion 158 is formed on a bottom surface of the first transfer path 142 that contacts the lower end portion 150D of the path switching guide unit 150 such that the printing medium P is not caught or ripped. Since a clearance may exist between the lower end portion 150D of the path switching guide unit 150 and the bottom surface of the first transfer path 142 that contacts, the printing medium P transferred along the second transfer path 144 (see FIG. 2) may get caught between the lower end portion 150D and the concave portion 158. In the present embodiment, the guide ribs 159 are formed in the concave portion 158 parallel to the transfer direction of the printing medium P. When the path switching guide unit 150 is installed in the main body frame (not shown), the plurality of guide ribs 159 are disposed between the plurality of grooves 156 formed in the lower end portion 150D of the path switching guide unit 150. Therefore, it is possible to prevent the printing medium P from being caught between the lower end portion 150D of the path switching guide unit 150 and the concave portion 158.

Figure 11:
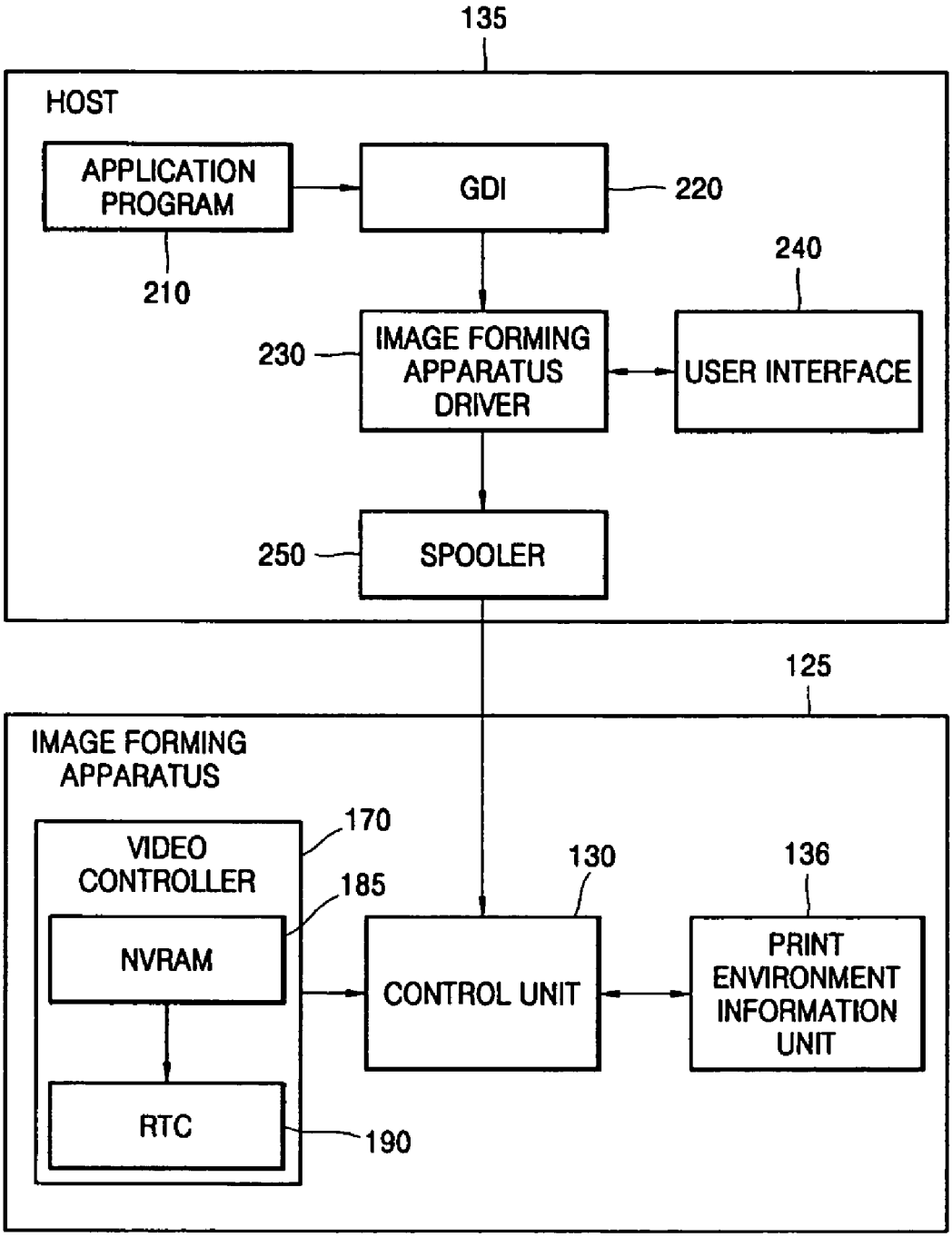
FIG. 11 is a block diagram illustrating an image forming system according to an embodiment of the present general inventive concept.
Figure 12:
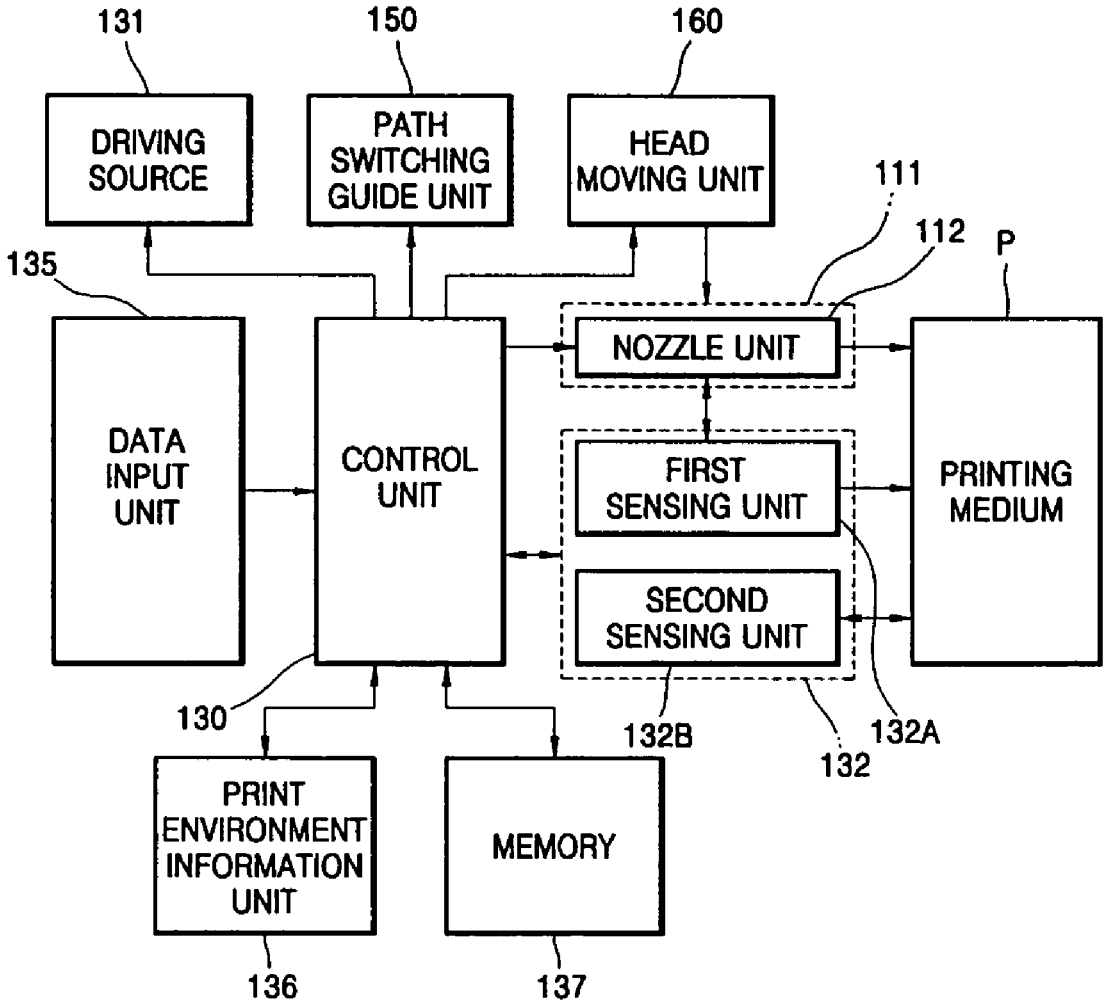
FIG. 12 is a block diagram illustrating an inkjet image forming apparatus of the image forming system of FIG. 11, according to an embodiment of the present general inventive concept.

FIG. 11 is a block diagram illustrating an image forming system according to the present general inventive concept, and FIG. 12 is a block diagram illustrating an inkjet image forming apparatus 125 of the image forming system of FIG. 11, according to an embodiment of the present general inventive concept. Here, the image forming system includes a data input unit 135 and the inkjet image forming apparatus 125. The inkjet image forming apparatus 125 may be similar to the image forming apparatus of FIG. 2 and may have some similar components. Accordingly, the image forming system of FIG. 11 and the image forming apparatus 125 of FIG. 12 are described with reference to FIGS. 2 through 10 in which similar reference numbers refer to similar components.

Referring to FIG. 11, the data input unit 135 may be a host system, such as a PC (Personal Computer), a digital camera, and PDA (Personal Digital Assistant), or the like. Image data to be printed is input to the data input unit 135 in an order of printing pages. The data input unit 135 includes an application program 210, a GDI (Graphics Device Interface) 220, an image forming apparatus driver 230, a user interface 240, and spooler 250. The application program 210 generates and edits objects which can be printed by the image forming apparatus 125. The GDI 220 is a program that runs on an operating system of the host system. The GDI 220 provides the object that is generated by the application program 210 to the image forming apparatus driver 230 and generates instructions associated with the object for the image forming apparatus driver 230.

The image forming apparatus driver 230 is a program that runs in the host system (i.e., the data input unit 135) and generates printer instructions which can be analyzed by the image forming apparatus 125. The user interface 240 for the image forming apparatus driver 230 is a program that runs on the host system and provides environment variables to enable the image forming apparatus driver 230 to generate the printer instructions. The spooler 250 is a program running in the operating system of the host system that provides the printer instructions generated by the image forming apparatus driver 230 to an input/output device (not shown) of the image forming apparatus 125.

The image forming apparatus 125 includes a video controller 170, the control unit 130, and a print environment information unit 136. The video controller 170 may include a non-volatile random access memory (NVRAM) 185 and a real time clock (RTC) 190.

The video controller 170 analyzes the printer instructions generated by the image forming apparatus driver 230, generates a bitmap according to the analyzed printer instructions, and provides the bitmap to the control unit 130. The control unit 130 provides the bitmap generated by the video controller 170 to the respective elements/components of the image forming apparatus 125 to control the elements/components to form an image on the printing medium P. The image forming apparatus 125 can perform a print job using the above-mentioned processes, among others.

Referring to FIG. 12, the control unit 130 is provided on a mother board of the image forming apparatus 125 and controls an ejecting operation of the nozzle unit 112 provided in the print head 111, a transferring operation of the printing medium transfer units 113, 115, 116, and 117, a path switching operation of the path switching guide unit 150, and a print head moving operation of the head moving unit 160. That is, the control unit 130 synchronizes the operations of the respective elements/components of the image forming apparatus 125 such that the ink ejected from the nozzle unit 112 reaches desired portions on the printing medium P when printing with a predetermined resolution. The control unit 130 stores the image data input through the data input unit 135 in a memory 137 and checks whether the storage of the image data in the memory 137 is completed. The sensing unit 132 senses information about a failed nozzle and provides the information to the control unit 130.

The printing environment information unit 136 stores various types of print environment information that correspond to print environments that are set when printing is performed. For example, when the image data is input from the application program 210 with a print command/request, an input print environment is associated with the image data. That is, the print environment information unit 136 stores the print environment information that corresponds to print environments input via the user interface 240 when the print request/command is input. Here, the print environment can include at least one of a printing density, a size of the printing medium P, a type of the printing medium P, a temperature, a humidity, and information about a continuous printing job. The control unit 130 controls the operations of the print head 111 and the printing medium transfer units 113, 115, 116, and 117 in accordance with the printing environments stored in the print environment information unit 136 that correspond to the input print environments.

When the storage of the image data is completed, the control unit 130 generates a control signal that corresponds to the input print environment to actuate the driving source 131, and the printing medium P is transferred by the printing medium transfer units 113, 115, 116, and 117 driven by the driving source 131. The control unit 130 controls the nozzle unit 112 such that the ink is ejected when the printing medium P transferred along the first transfer path 142 passes under the nozzle unit 112. The control unit 130 generates and outputs control signals to control the nozzle unit 112, and the nozzle unit 112 prints the image data on the printing medium P in response to the control signals. Accordingly, the control unit 130 performs the print job in accordance with the print environment information stored in the print environment information unit 136 and the information about a failed nozzle sensed by the sensing unit 132.

A method of performing a high resolution printing when an input printing resolution (i.e., a desired resolution) is higher than the actual resolution of the print head 111 will now be described. The inkjet image forming apparatus performs a print job by transferring the printing medium P by the print head 111 in multiple passes in a multi-pass type method. That is, the control unit 130 controls the operations of the printing medium transfer units 113, 115, 116, and 117 such that the printing medium P transferred along the first transfer path 142 is transferred back to the first transfer path 142 via the second transfer path 144. In order to perform a print job with a high resolution, the control unit 130 moves the print head 111 in the second direction in accordance with the input printing resolution stored in the print environment information unit 136 that corresponds to the desired resolution. If the desired resolution is "L," the actual resolution of the print head 111 is "M," and "N" is equal to (UM), then the control unit 130 controls the operation of the path switching guide unit 150 such that the printing medium P is repeatedly transferred back to the first transfer path 142 (N−1) times. That is, the printing medium P is transferred in N passes such that as the desired resolution increases, a number times that the printing medium P is transferred along the first transfer path 142 (i.e., a printing path) also increases.

The control unit 130 may control the operation of the head moving unit 160 such that the print head 111 is moved in the second direction by $(1/N)\times D+(n\times D)$ with respect to the initial position of the print head 111 whenever the printing medium P is transferred along the second transfer path 144. In other words, the control unit 130 can move the print head 111 while the printing medium P is being looped back around to the first transfer path 142 via the second transfer path 144. The first and second transfer paths 142 and 144 may collectively form a looped path. Here, "D" is the nozzle pitch of the print head 11 and "n" is an integer.

The control unit 130 may control the operation of the head moving unit 160 such that the print head 111 is moved in the second direction by $(m/N)\times D+(n\times D)$ with respect to the initial position of the print head 111 whenever the printing medium P is transferred along the second transfer path 144. Here, "D" is the nozzle pitch, "n" is an integer, and "m" is varied from 0 up to (N−1) by incrementing whenever the printing medium P is transferred along the second transfer path 144.

Figure 13:
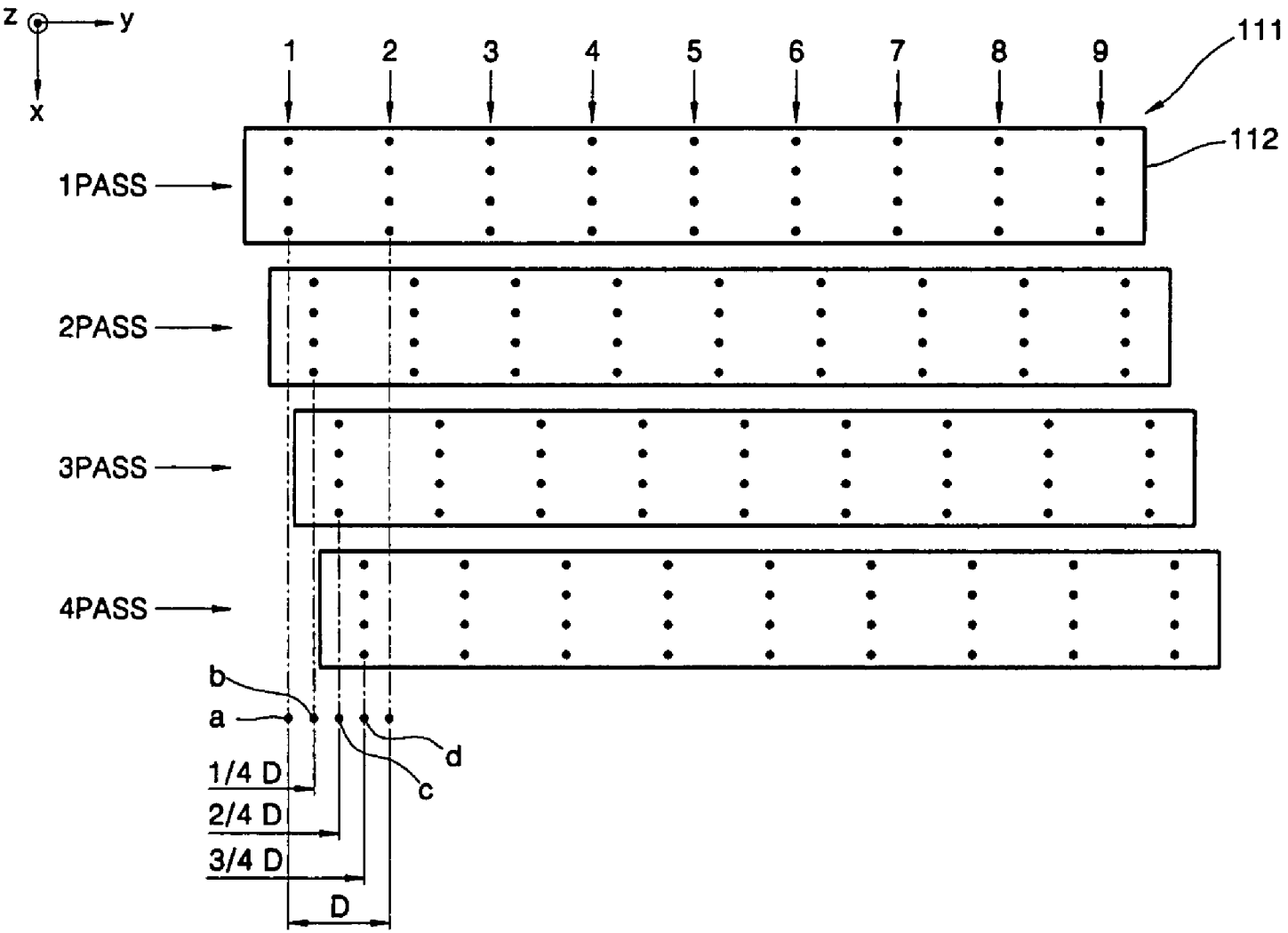
FIG. 13 illustrates an example in which a high resolution printing is performed using a multi-pass method, according to an embodiment of the present general inventive concept.
Figure 14:
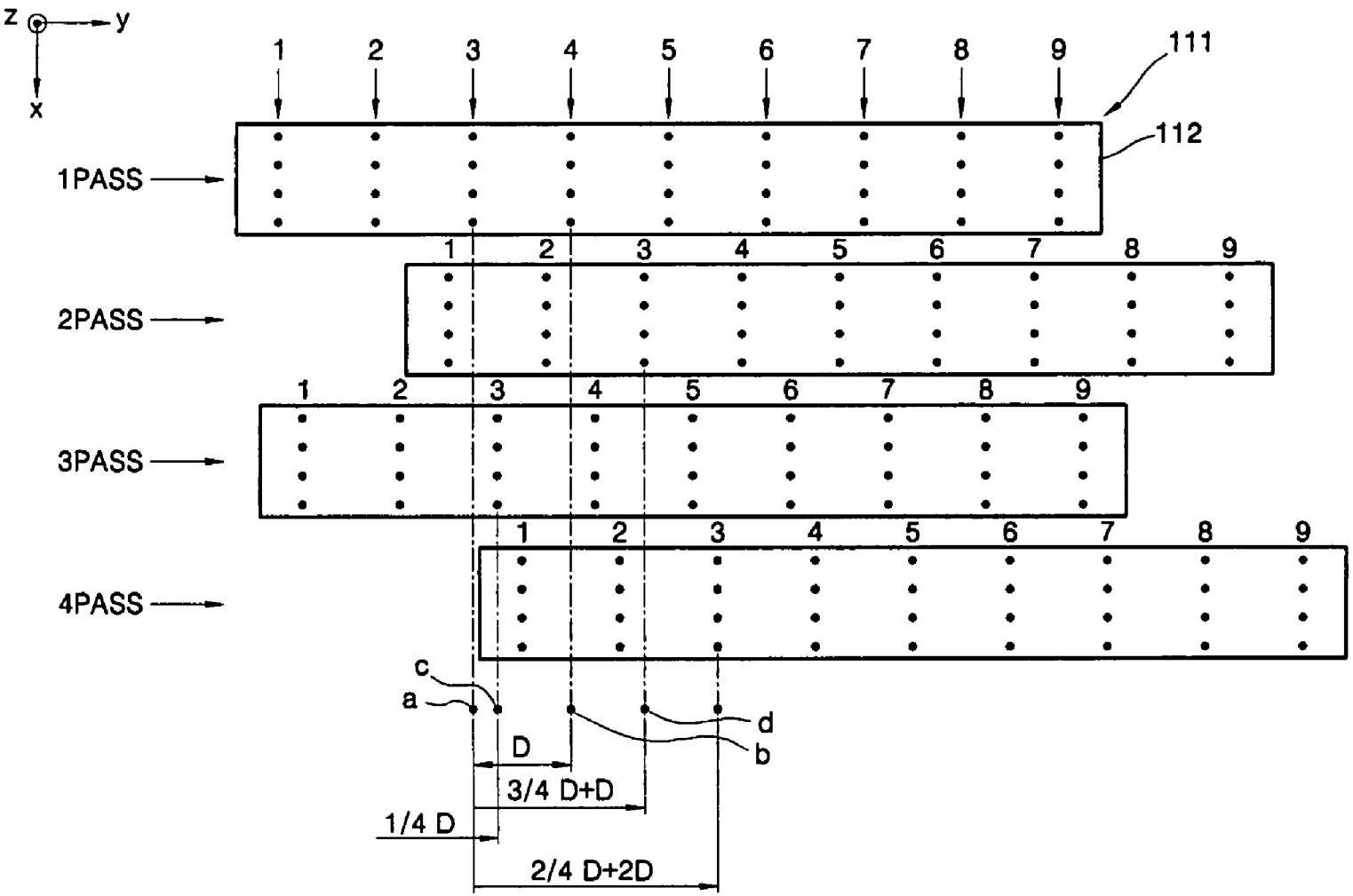
FIG. 14 illustrates another example in which a high resolution printing is performed using the multi-pass method, according to an embodiment of the present general inventive concept.

FIG. 13 illustrates an example in which a high resolution printing is performed using multiple passes (i.e., 4 passes) in a multi-pass method, and FIG. 14 illustrates another example in which a high resolution printing is performed using the multiple passes (i.e., 4 passes) in the multi-pass method. Hereinafter, a case in which the actual resolution "M" of the print head 111 is 1200 dpi (dots-per-inch) and the desired resolution "L" is 4800 dpi will be used to explain the operation of the inkjet image forming apparatus according to embodiments of the present general inventive concept. As illustrated FIGS. 13 and 14, the printing medium P is repeatedly transferred N−1 times along the second transfer path 144 (i.e., back to the first transfer path 142). In the present embodiment, the printing medium P is transferred along the second transfer path 144 three times (i.e., L/M−1). Nozzle arrays of the nozzle unit 112 are represented from the left by 1, 2, 3, . . . 9, a position of the nozzles during a first pass of the printing medium P is represented by "a," a position of the nozzles during a second pass of the printing medium P is represented by "b," a position of the nozzles during a third pass of the printing medium P is represented by "c," and a position of the nozzles during a fourth pass of the printing medium P is represented by "d."

Referring to FIG. 13, the print head 111 is shifted in the second direction by (1/N)×D+(n×D) with respect to the initial position of the print head 111 whenever the printing medium P is transferred along the second transfer path 144. When the value of "n" is positive (+) and the printing medium P is transferred along the second transfer path 144, the print head 111 is shifted to the right. When the value of "n" is negative (−) and the printing medium P is transferred along the second transfer path 144, the print head 111 is shifted to left. In the present embodiment, in which nozzle 1 is a reference nozzle and the value of "n" is 0 is used as an example. The print head 111 is shifted by D/4 each time the printing medium P is transferred along the second transfer path 144. Nozzle 1 corresponds to the position "a" (initial position) of the print head 111 during the first pass of the printing medium P. The printing medium P on which an image (i.e. a first portion of the image) is printed is transferred back to the first transfer path 142 along the second transfer path 144. Nozzle 1 corresponds to the position "b," which is shifted to the right by D/4 from the initial position during the second pass of the printing medium P. The printing medium P on which the image (i.e., the first portion and a second portion of the image) is printed is then transferred back to the first transfer path 142 along the second transfer path 144. Nozzle 1 corresponds to the position "c," which is shifted to right by 2D/4 from the initial position during the third pass of the printing medium P. The printing medium P on which the image (i.e., the first portion, the second portion, and a third portion of the image) is printed is then transferred back to the first transfer path 142 along the second transfer path 144. Nozzle 1 corresponds to the position "d," which is shifted to right by 3D/4 from the initial position during the fourth pass of the printing medium P. That is, nozzle 1 is shifted by 0→D/4→2D/4→3D/4 with respect to the initial position each pass of the printing method. Accordingly, an image that corresponds to a horizontal resolution of 4800 dpi is printed on the printing medium P. It is also possible to improve a vertical resolution of the image by reducing a transfer speed of the printing medium P.

Referring to FIG. 14, the print head 111 is shifted in the second direction by (m/N)×D+(n×D) with respect to the initial position of the print head 111 whenever the printing medium P is transferred along the second transfer path 144. When the printing medium P is transferred along the second transfer path 144 and the value of "n" is positive (+), the print head 111 is shifted to the right. When the printing medium P is transferred along the second transfer path 144 and the value of "n" is negative (−), the print head 111 is shifted to the left. In the present embodiment, a case in which nozzle 3 is a reference nozzle and the values of "m" and "n" vary is used as an example. Nozzle 3 corresponds to the position "a" (initial position) during the first pass of the printing medium P. The printing medium P on which an image (i.e., a first portion of the image) is printed is then transferred back to the first transfer path 142 along the second transfer path 144. Nozzle 3 corresponds to the position "b," which is shifted to the right by 3D/4+D from the initial position during the second pass of the printing medium P. The printing medium P on which the image (i.e., the first portion and a second portion of the image) is printed is then transferred back to the first transfer path 142 along the second transfer path 144. Nozzle 3 corresponds to the position "C," which is shifted to the left by 2D/4−2D from the position "b" during the second pass (i.e., the position "c" is shifted to the left by D/4 from the initial position) during the third pass of the printing medium P. The printing medium P on which the image (i.e., the first portion, the second portion, and a third portion of the image) is printed is then transferred back to the first transfer path 142 along the second transfer path 144. Nozzle 3 corresponds to the position "d," which is shifted to the right by D/4+2D from the position "c" during the third pass (i.e., the position "d" is shifted to the right by 2D/4+2D from the initial position) during the fourth pass of the printing medium P. More specifically, the value of "m" varies from 0→3/4→1/4→2/4 with respect to the initial position each pass, and the value of "n" varies from 0→1→0→+2. In other words, nozzle 3 is shifted by 0→3D/4+D→D/4→2D/4+2D with respect to the initial position each respective pass. Accordingly, an image that corresponds to a horizontal resolution of 4800 dpi is printed on the printing medium P. Additionally, a vertical resolution can be improved by slowing the transfer speed of the printing medium P.

Figure 15A:
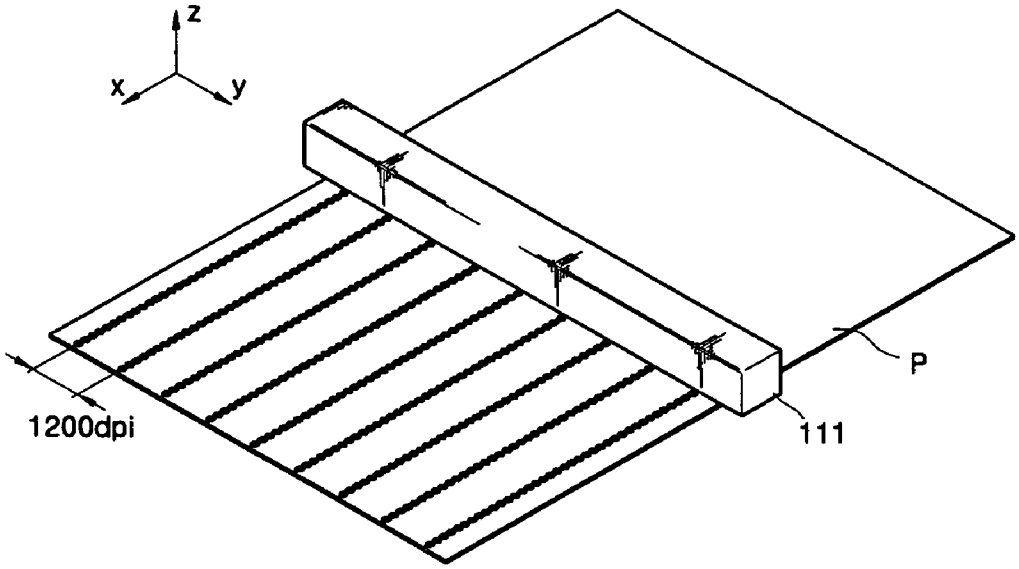
FIG. 15A illustrates a pattern printed with an actual resolution of a print head.
Figure 15B:
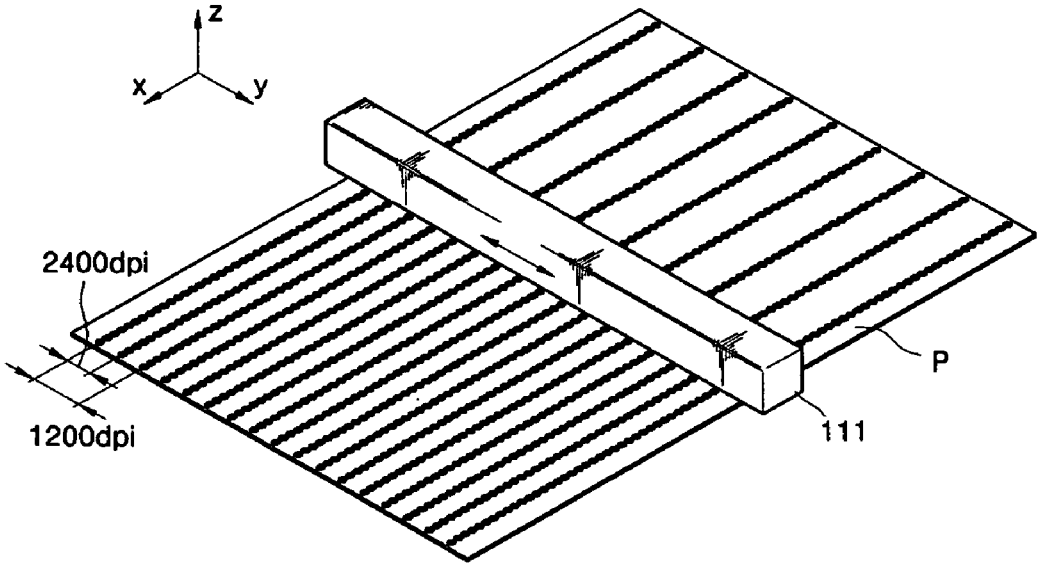
FIG. 15B illustrates a pattern printed with two times the actual resolution of the print head.
Figure 15C:
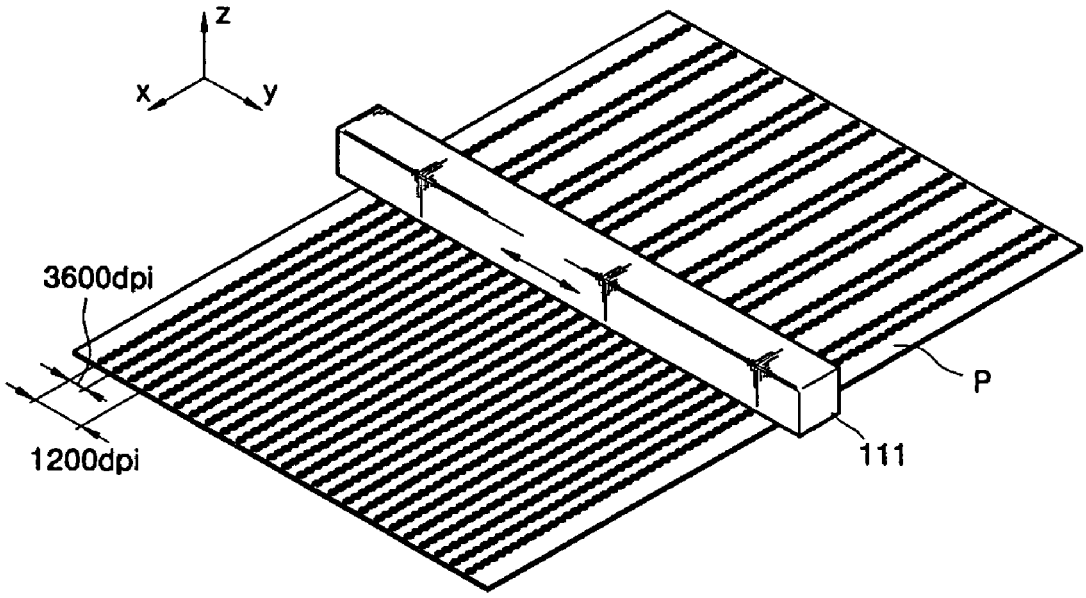
FIG. 15C illustrates a pattern printed with three times the actual resolution of the print head.
Figure 15D:
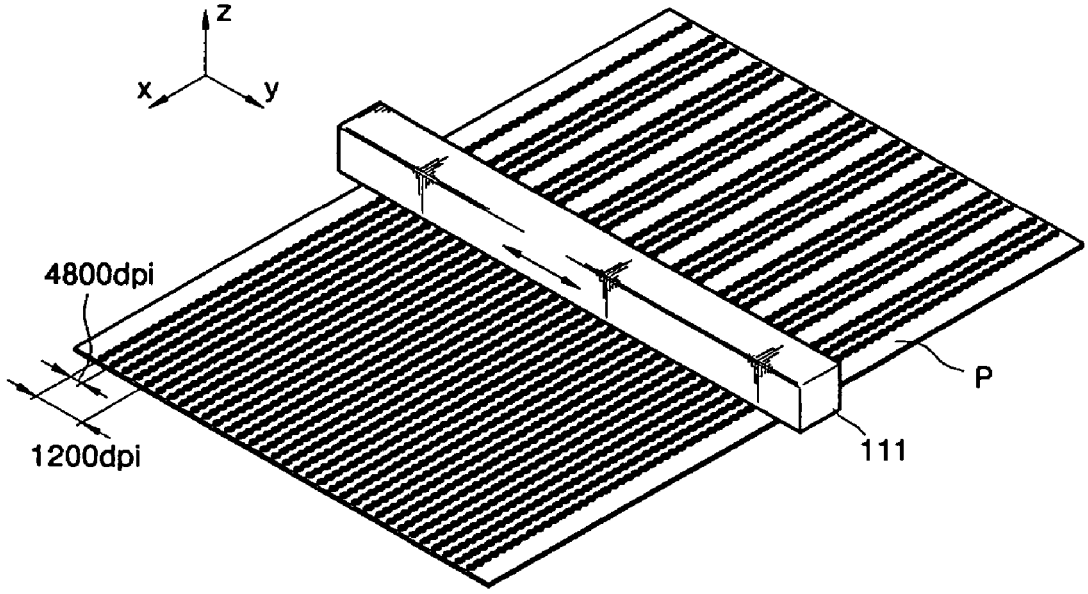
FIG. 15D illustrates a pattern printed with four times the actual resolution of the print head.

A pattern that is printed using the above-mentioned method(s) is illustrated in FIGS. 15A to 15D. FIG. 15A illustrates a pattern that is printed using the actual resolution of the print head 111 (i.e., one pass), FIG. 15B illustrates a pattern that is printed using two times the actual resolution of the print head 111 (i.e., two passes), FIG. 15C illustrates a pattern that is printed using three times the actual resolution of the print head 111 (i.e., three passes), and FIG. 15D illustrates a pattern that is printed using four times the actual resolution of the print head 111 (i.e., four passes).

The pattern printed using the horizontal resolution of 1200 dpi is illustrated in FIG. 15A. When the pattern is printed with a 2400 dpi resolution using the print head 111 having an actual resolution of 1200 dpi, the printing medium P is printed with the resolution of 1200 dpi while being transferred along the first transfer path 142 during a first pass. After completing a first printing operation of the first pass, the printing medium P is transferred again to the first transfer path 142 along the second transfer path 144. The printing medium P transferred is again subjected to a second printing operation of a second pass to print with the resolution of 2400 dpi by the print head 111, which is horizontally shifted in the second direction (y direction), as illustrated in FIG. 15B. That is, the resolution of 2400 dpi is obtained by printing twice and shifting the print head 111 once in between the first and second printing operations. The resolutions of 3600 dpi (FIG. 15C) and 4800 dpi can be performed using the same method as described above to perform third and fourth printing operations during third and fourth passes, respectively.

A method of performing a high resolution printing in an inkjet image forming apparatus according to an embodiment of the present general inventive concept will now be described.

Figure 16:
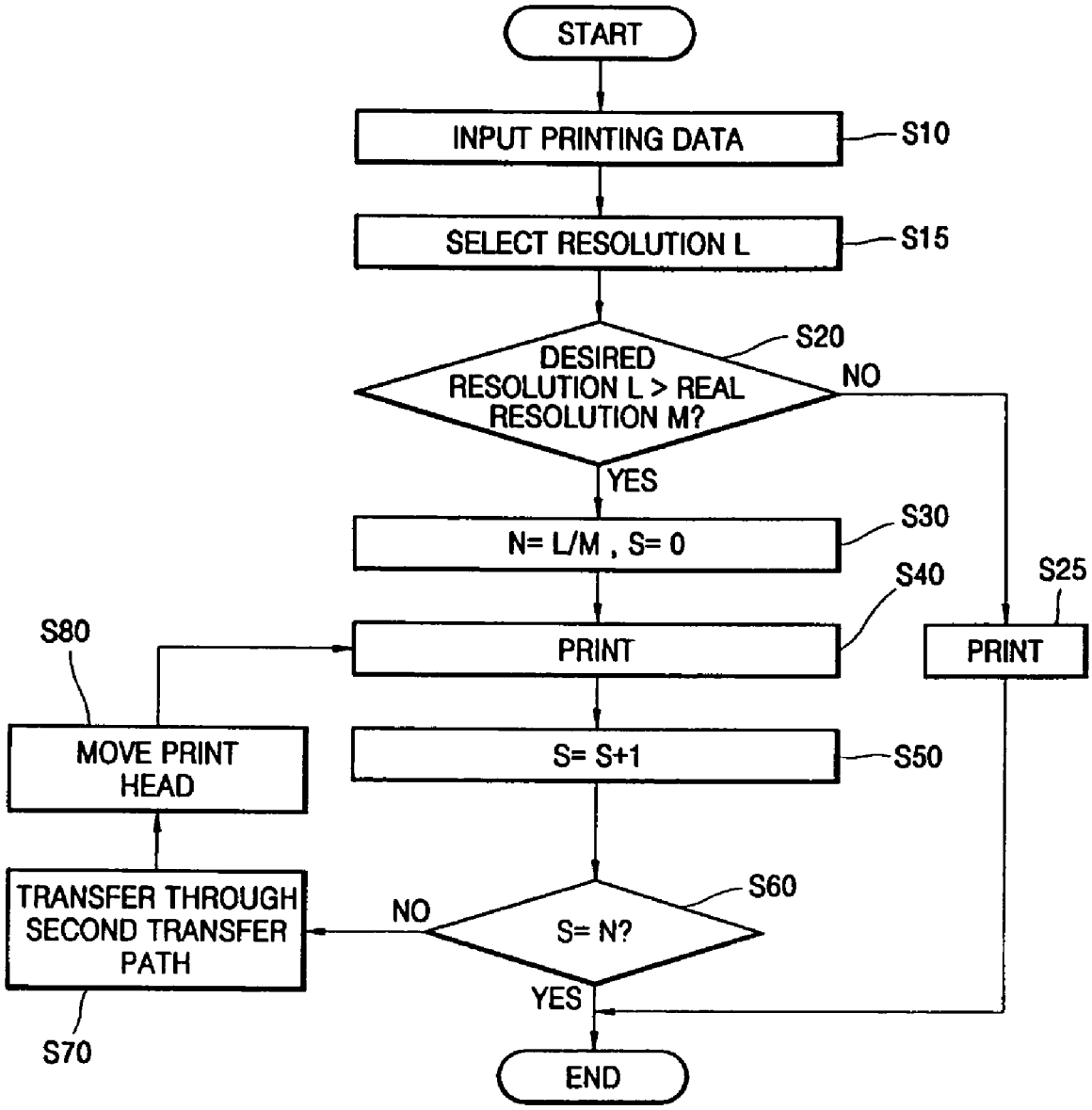
FIG. 16 is a flowchart illustrating a method of performing a high resolution printing in an inkjet image forming apparatus according to an embodiment of the present general inventive concept.

FIG. 16 is a flowchart illustrating the method of performing a high resolution printing in an inkjet image forming apparatus according to an embodiment of the present general inventive concept. The method of FIG. 16 may be performed in the image forming apparatus of FIGS. 2, 11, and/or 12. Accordingly, for illustration purposes, the method of FIG. 16 is described below with reference to FIGS. 2 to 16.

Referring to FIG. 16, data to be printed is input through by a host (operation S10). Once the data to be printed is input, a user can input or select the desired resolution "L" through the user interface 240 (operation S15). Alternatively, the desired resolution "L" may be preset. The input resolution "L" (i.e., the desired resolution) and the actual resolution "M" of the print head 111 may be different from each other. Accordingly, the image forming apparatus compares the input resolution "L" and the actual resolution "M" of the print head 111 (operation S20), and then performs the subsequent image forming processes.

When the input resolution "L" and the actual resolution "M" are equal, the printing is performed on the printing medium P using a process input as a default process (operation S25). That is, the printing medium P is transferred along the first transfer path 142 and is discharged through the sheet discharge path 146 after an image is printed thereon.

On the other hand, when the input resolution "L" is greater than the actual resolution "M," an image is printed while transferring the printing medium P (using multiple passes) in a multi-pass process. When the desired resolution "L" is greater than the actual resolution "M," a number of passes (i.e., multi-pass) L/M to be performed is stored as the value of "N" in a memory of the control unit 130 and "0" is stored as the value of a counter "S" used to keep track of the number of passes that are performed(operation S30). In other words, the counter "S" is initialized, and the number of passes L/M is stored as "N." Thereafter, the printing medium P is transferred along the first transfer path 142 and an image (i.e., the first portion of the image) is printed while the printing medium P is transferred (operation S40). After the image is printed during the first pass, the value of the counter "S" is updated and increased by 1 (operation S50). Then, the updated value of "S" and the value of "N" are compared with each other (operation S60). If the value of "S" and the value of "N" are different from each other, the control unit 130 transfers the printing medium P to the first transfer path 142 along the second transfer path 144 (operation S70). At this time, the control unit 130 controls the operation of the head moving unit 160 to move the print head 111 along the length direction thereof (operation S80) and then ejects the ink from the print head 111 to the printing medium P that is transferred again to perform a second (or subsequent) printing operation (operation S40) during the second (or subsequent) pass. When the value of "S" and the value of "N" are determined to be equal to each other at the operation S60 (i.e., after the printing medium P is repeatedly transferred to the first transfer path 142 along the second transfer path 144 N−1 times) the printing medium P is discharged through the sheet discharge path 146.

The print head 111 may be shifted along the length direction thereof by $(1/N)\times D+(n\times D)$ with respect to the initial position of the print head 111 in the operation S80, whenever the printing medium P is transferred along the second transfer path 144. Here, "D" is the nozzle pitch and "n" is an integer. Alternatively, the print head 111 may be shifted along the length direction thereof by $(m/N)\times D+(n\times D)$ with respect to the initial position of the print head 111 in the operation S80, whenever the printing medium P is transferred along the second transfer path 144. Here, "D" is the nozzle pitch, "n" is an integer, and "m" is varied from 0 up to (N−1) by incrementing whenever the printing medium P is transferred along the second transfer path 144.

Referring to FIGS. 2 and 16, the method of FIG. 16 described above will now be described with reference to an example in which the desired resolution "L" for printing is 4800 dpi, and the print head 111 has an actual resolution "M" of 1200 dpi. When printing data for an image of 4800 dpi resolution is input, N=4 is set. After the first printing operation is performed on the printing medium P during the first pass, the printing medium P is transferred to the first transfer path 142 along the second transfer path 144 by adjusting the path switching guide unit 150 so as to perform the second printing operation (i.e., to print again) on the printing medium P during the second pass. At this time, the print head 111 is shifted along the length direction thereof by D/4 or D/4+ integer by the head moving unit 160 so as to perform a print job with the 4800 dpi resolution. An image with the resolution of 4800 dpi is printed on the printing medium P by repeating the above-mentioned operations using four passes.

Operation of the image forming apparatus which can perform a high resolution printing through the above-mentioned operations will now be described.

When the print command/request is input, the printing medium P is picked up from the sheet feed cassette 120 and is transferred to the print head 111 along the first transfer path 142. The first printing operation is performed while the printing medium P passes under the print head 111 (i.e., the first pass). When the first printing operation is complete, the control unit 130 determines and/or stores that the printing operation is performed once (S=1) and the value of the counter "S" is compared with the value of "N" determined based on the input resolution "L." Since the value of the counter "S" is less than the value of "N," which is 4 at the time of the first printing operation, the path switching guide unit 150 transfers the printing medium P along the second transfer path 144. At this time, the print head 111 is moved along the length direction. After the printing medium P is transferred to the first transfer path 142 along the second transfer path 144 and the movement of the print head 111 is completed, the second printing is performed (i.e., the second pass). When the second printing operation is completed, 2 is stored as the value of the counter "S," and the value of the counter "S" is then compared with the value of "N." Since the value of the counter "S," which is 2, is less than the value of "N," which is 4, the path switching guide unit 150 then transfers the printing medium P along the second transfer path 144 again for the third pass such that the print head 111 performs the third printing operation. After the printing medium P is transferred again to the first transfer path 142 along the second transfer path 144 and the movement of the print head 111 is completed, the third printing operation is performed. When the third printing operation is completed, 3 is stored as the value of the counter "S." Since the value of the counter "S," which is 3, is still less than the value of "N," which is 4, after the third printing operation, the printing medium P is transferred again to the first transfer path 142 along the second transfer path 144 for the fourth pass and the print head 111 is moved to perform the fourth printing operation. Then, the fourth printing operation is performed. After the fourth printing operation is completed, 4 is stored as the value of the counter "S." At this time, since the value of the counter "S" is equal to the value of "N," the path switching guide unit 150 is moved to a position to discharge the printing medium P via the discharge path 146. Accordingly, the printing medium P on which an image is printed with the 4800 dpi resolution is discharged through the sheet discharge path 146.

According to the image forming apparatus and method of performing the high resolution printing of the embodiments of the present general inventive concept described above, it is possible to perform a high resolution printing by performing a printing operation while moving a print head above a printing medium that is transferred in multiple passes. In addition, missing dots that result from failed nozzles can be properly compensated for by performing the printing operation while transferring the printing medium P in multiple passes. That is, since the printing operation is performed with the movement of the print head in a multi-pass type printing method, the missing dots that result from the failed nozzles can be distributed on the printing medium P, thereby minimizing a visible effect thereof.

As described above, in an inkjet image forming apparatus and a method of performing a high resolution according to various embodiments of the present general inventive concept, a target point of ink droplets ejected from a nozzle can be varied by performing a printing in a multi-pass type printing method using multiple passes. Therefore, by adjusting a number of passes of the printing medium and a degree of movement of the print head, it is possible to obtain an image quality with a high resolution. An actual resolution of the print head is determined by a nozzle pitch, yet in the various embodiments of the present general inventive concept, it is possible to output an image with a resolution that is higher than the actual resolution by using a multi-pass type printing method. Even when one or more of the nozzles provided in the print head are damaged, it is possible to prevent a reduction in image quality due to the damaged nozzles by moving the print head along a length direction thereof when printing such that the target points of the ink droplets ejected from the damaged nozzles are varied. In addition, it is possible to more stably perform a path switching operation and to prevent the printing medium from being caught between a lower end portion and a concave portion in a path switching guide unit usable in the multi-pass type printing method.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet image forming apparatus, comprising:

a print head to eject ink to form an image on a printing medium that is transferred along a first direction and being movable in a second direction with respect to the printing medium;

a first transfer path to guide the printing medium such that the printing medium is transferred to the print head;

a second transfer path connected to the first transfer path to guide the printing medium such that the printing medium on which the image is printed is transferred back to the print head on the first transfer path;

a path switching guide unit provided where the first transfer path and the second transfer path meet each other and to guide the printing medium such that the printing medium is discharged from the apparatus or transferred to the second transfer path, the path switching guide unit comprises:

a guide body;

a first shaft disposed on the guide body to protrude from both sides surfaces of the guide body;

a second shaft inserted into an upper end portion of the guide body and having a shaft center that coincides with a shaft center of the first shaft; and a support portion formed at the upper end portion of the guide body to support the second shaft not to be separated therefrom;

a printing medium transfer unit provided in the first and second transfer paths to transfer the printing medium along the first and second transfer paths;

a head moving unit to move the print head in the second direction; and a control unit to synchronize operations of the path switching guide unit, the printing medium transfer unit, and the head moving unit such that the ink ejected from the print head reaches a target portion on the printing medium, wherein the control unit moves the print head in the second direction when the printing medium is transferred to the first transfer path along the second transfer path.

2. The inkjet image forming apparatus according to claim 1, further comprising:

a print environment information unit to store information about a selected printing resolution when printing with the selected printing resolution is performed, wherein the control unit moves the print head in accordance with the selected printing resolution stored in the print environment information unit.

3. The inkjet image forming apparatus according to claim 2, wherein the control unit controls the path switching guide unit such that the printing medium is repeatedly transferred along the second transfer path (N−1) times, where "L" represents the selected printing resolution, "M" represents an actual resolution of the print head, and "N" is equal to (L/M).

4. The inkjet image forming apparatus according to claim 3, wherein the control unit controls the head moving unit such that the print head is shifted in the second direction by $(1/N)\times D+(n\times D)$ with respect to an initial position of the print head each time the printing medium is transferred along the second transfer path, where "D" is a nozzle pitch and "n" is an integer.

5. The inkjet image forming apparatus according to claim 3, wherein the control unit controls the head moving unit such that the print head is shifted in the second direction by $(m/N)\times D+(n+D)$ with respect to an initial position of the print head each time the printing medium is transferred along the second transfer path, where "D" is a nozzle pitch, "n" is an integer, and "m" is varied from 0 up to (N−1) by incrementing each time the printing medium P is transferred along the second transfer path.

6. The inkjet image forming apparatus according to claim 1, wherein the head moving unit comprises a driver to move the print head to reciprocate in the second direction.

7. The inkjet image forming apparatus according to claim 6, wherein the driver comprises a piezoelectric actuator coupled to the print head.

8. The inkjet image forming apparatus according to claim 6, wherein the head moving unit further comprises a bias unit to bias the print head moved by the driver toward an initial position.

9. The inkjet image forming apparatus according to claim 8, wherein the bias unit comprises an elastic member disposed between a main body frame of the inkjet image forming apparatus and the print head.

10. The inkjet image forming apparatus according to claim 6, wherein the head moving unit further comprises a guide portion to guide the reciprocation of the print head.

11. The inkjet image forming apparatus according to claim 10, wherein:

the print head comprises a coupling portion penetrated along a portion thereof; and the guide portion comprises a guide shaft inserted into the coupling portion to guide the reciprocation of the print head.

12. The inkjet image forming apparatus according to claim 10, wherein the guide portion comprises a guide rail to guide the reciprocation of the print head.

13. The inkjet image forming apparatus according in claim 10, wherein the second shaft comprises metal having a resistance to deformation.

14. The inkjet image forming apparatus according to claim 10, wherein the path switching guide unit further comprises:

a plurality of grooves formed at a lower end portion of the guide body to be perpendicular to an edge of the lower end portion.

15. The inkjet image forming apparatus according to claim 10, wherein the support portion comprises:

a plurality of first support portions protruding from a first side surface of the upper end portion of the guide body; and a plurality of second support portions protruding from a second side surface of the guide body to partially surround an outer circumferential surface of the second shaft along with the first support portions.

16. The inkjet image forming apparatus according to claim 1, wherein the print head comprises a nozzle unit having a length that corresponds to a width of the printing medium.

* * * * *